US005484139A

United States Patent [19]

Wolfson et al.

[11] Patent Number: 5,484,139

[45] Date of Patent: Jan. 16, 1996

[54] SYSTEM FOR HANDLING CURVED FORM MEDIA AND CASSETTE THEREFOR

[75] Inventors: Lawrence S. Wolfson, West Hartford, Conn.; Philip W. Cenedella, East Douglas, Mass.; Joseph Conlan, Rocky Hill, Conn.

[73] Assignee: Gerber Systems Corporation, South Windsor, Conn.

[21] Appl. No.: 71,567

[22] Filed: Jun. 1, 1993

[51] Int. Cl.[6] ..... B65H 85/00

[52] U.S. Cl. ..... 271/3; 271/5; 271/14; 271/145; 271/161; 271/164; 355/85

[58] Field of Search ..... 271/3, 4, 5, 10, 271/11, 14, 3.1, 145, 161, 164, 207; 355/72, 85 X, 91, 89; 346/307, 310

[56] References Cited

U.S. PATENT DOCUMENTS

| | | | |
|---|---|---|---|
| 971,245 | 9/1910 | Brewer et al. | 271/161 X |
| 4,571,073 | 2/1986 | Dietrich et al. | 271/5 X |
| 4,699,370 | 10/1987 | Hashmimoto et al. | 271/98 |
| 4,740,817 | 4/1988 | Suzuki et al. | 271/164 X |
| 4,804,173 | 2/1989 | Pol et al. | 271/11 |
| 4,815,721 | 3/1989 | Morgan | 271/3.1 |
| 4,993,698 | 2/1991 | Buelens et al. | 271/145 |
| 5,207,414 | 5/1993 | Schimanski et al. | 271/5 |
| 5,273,272 | 12/1993 | Nakamura et al. | 271/164 |

FOREIGN PATENT DOCUMENTS

| | | |
|---|---|---|
| 0004993 | 10/1979 | European Pat. Off. . |
| 1293013 | 10/1972 | United Kingdom . |

*Primary Examiner*—H. Grant Skaggs
*Assistant Examiner*—Carol L. Druzbick
*Attorney, Agent, or Firm*—McCormick, Paulding & Huber

[57] ABSTRACT

A media handling unit is a selfcontained device which is capable of being moved to existing photoplotting structures to transport media sheets from a supply cassette housed within the unit and advanced into the plotter for conducting a plotting operation. The unit also retreives the scanned media from the photoplotter returning it the unit in a light tight environment where the scanned film is deposited onto a collecting tray. The supply of film is provided in a cassette having a semi-cyldrical support surface causing the film to take on a preformed configuration which is generally coincident with the shape of the support surface on the plotter.

34 Claims, 19 Drawing Sheets

SYSTEM FOR HANDLING CURVED FORM MEDIA AND CASSETTE THEREFOR

CROSS REFERENCE TO RELATED APPLICATIONS

This application relates generally to co-pending U.S. application Ser. No. 07/839,398 entitled Plotter Drum and Methods of Fabrication and Alignment Therefor, filed on Feb. 20, 1992, in the name of Allen W. Menard et al, now U.S. Pat. No. 5,276,465 and further relates to U.S. patent application Ser. No. 07/660,280 entitled Media Handling System for Photoplotter and Method of Use, filed on Feb. 22, 1991 in the name of Schimanski et al, now U.S. Pat. No. 5,207,414, which applications are commonly signed to Gerber Systems Corporation, the assignee of the present invention.

BACKGROUND OF THE INVENTION

This invention relates generally to photoplotter equipment, and more particularly a stand alone device for the on loading and off loading of media onto the curved surface of a drum or crescent-type plotting apparatus.

It has been found that drum type photoplotting apparatus of the type disclosed in aforementioned U.S. Pat. No. 07/839,398, present a significant advance in the imaging art by allowing imaging to be done in raster format onto a photosensitive media by supporting a media sheet on a partially cylindric support surface and controllably rotating a mirror along the center of curvature of that surface to effect such scanning. In order that the media be allowed to conform in this manner to the curvature of the support surface, it is necessary that each sheet have a very thin dimension, for example, on the order of 0.007 inches, hence making it highly flexible. One drawback to this is that the media sheet is somewhat mechanically unstable in terms of its being capable of being readily handled by an operator, thus making the overall plotting operation less efficient than it otherwise could be. That is, the drum plotter disclosed in co-pending U.S. application Ser. No. 07/839,398 is capable of rapidly scanning a number of media sheets in succession at a rate which is basically limited by the handling capacity of the operator. In the past, such manual handling operations involved the placing a film onto the support surface of a drum plotter so as to cause it to be held in alignment on that surface and subsequently scanned. Such manual placing of the media sheet onto the support surface of the plotter involved requiring the operator to insure that the media was also positioned accurately along a given datum referenced to the scanning operation. This step likewise added time and effort to the process. Additionally, the process of removing the thin film sheets from the curved support surface and then placing each sheet in a collecting tray was a further burden on the plotting operation. Through this all, the media which is made purposely sensitive to certain ranges of radiant energy, often including room light, must be handled in this manner in a dark room environment, which made the handling of the media within the already restrictive confines of the drum plotter, that much more difficult to manage.

A number of such drum plotters presently exist in the marketplace, which as mentioned, have been widely and successfully received in the marketplace. Thus, any solution to the aforesaid problems in the handling of media in a manner other than that which has been discussed above, must be made with the existing structure of these plotters in mind.

Accordingly, it is an object of the present invention to provide a media handling system for photoplotters using a crescent or drum shaped support surface wherein the media handled is in the form of a flexible sheet of material, i.e. film, which is advanced by the unit from a supply of such media onto the support surface of the plotter in registry with a given datum in the plotter and wherein after a scanning operation is completed on such media, it is automatically removed from the support surface of the plotter and returned to the unit and placed in a collecting tray.

It is yet a further object of the invention to provide a handling unit wherein media is handled in the aforementioned manner in a light-tight environment while maintained within the interior of the unit as well as while it is out of the unit.

It is a further object of the invention to house a stack of unexposed media or film in a light-tight cassette such that individual media sheets can be off-loaded and placed in registration onto the support surface for exposure by the scanning mechanism and subsequently be returned to a collecting station in the unit which is likewise sealed against light.

Still a further object of the present invention is to provide a transportable unit that is capable of handling media in the aforementioned manner which is adaptable to the existing structure of plotters which already exist in the market so as to mate with such units to create a light-tight passage therebetween for handling of media during a plotting operation therethrough.

A further object of the invention is to provide a supply cassette in which the media is caused to take on a given configuration conformable to the shape of the support surface of the plotter to which it is to be used so that the media is capable of being advanced onto the support surface in substantially the same configuration which it will assume when once placed on the involved support surface.

Yet, a further object of the invention is to provide a method of advancing thin sheets of film from a supply of such film onto the support surface in a photoplotter for scanning and subsequent removal by the apparatus and placement into a light-tight collecting tray for subsequent developing and/or processing.

SUMMARY OF THE INVENTION

The invention resides in a media handling unit for moving media between discrete locations. The unit for this purpose comprises a frame, a supply means supported by said frame for providing a source of media conformed to a generally partial cylindric shape while being maintained in said supply means. The system includes a first positioning means positioned above said supply means and slidably moveably mounted to said frame for movement between a first position corresponding to where the first positioning means extends in part generally above said supply means and a second position corresponding to where the first positioning means extends in part outwardly of said frame. A second positioning means is provided and is carried by said first positioning means for movement relative to both said frame and to said first positioning means. The second positioning means itself carries a third positioning means which is vertically moveable relative thereto for lifting media from said supply means in its conformed cylindric shape and moving said media while maintaining it in said conformed cylindric shape to discrete locations remote of said supply means under the combined movements of said first and said second positioning means. Control means are further used to connect said first, second and third positioning means to control the movements of the same to effect handling of media between said discrete positions.

The invention further resides in a method of handling media in accordance with the apparatus of the aforementioned system as well as in the design of the supply cassette and collecting tray used to provide media as well as to collect it.

DETAILED DESCRIPTION OF THE PREFERRED EMBODIMENT

Figure 1:
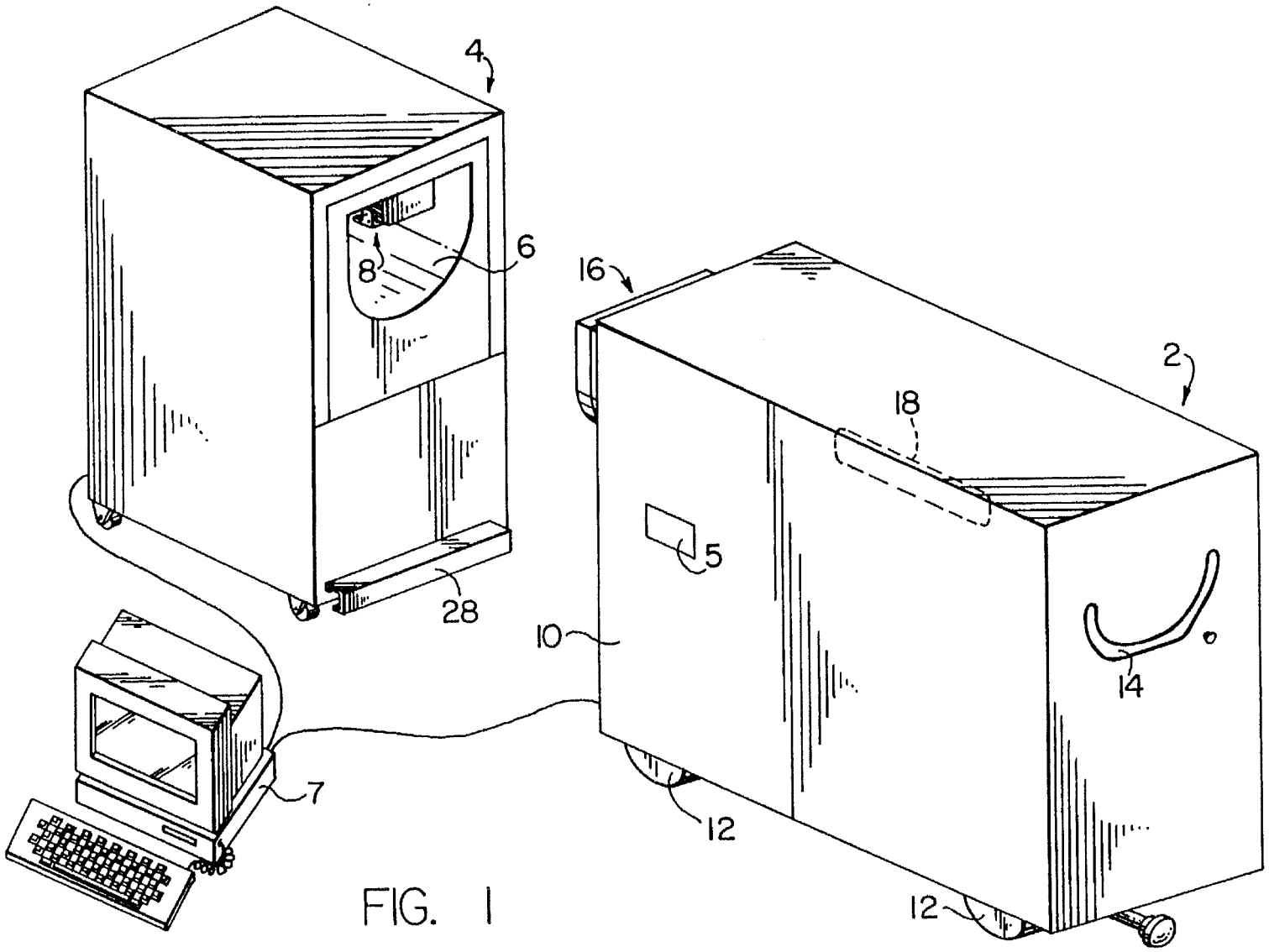
FIG. 1 is a perspective view illustrating the handling unit separate from the plotter assembly prior to their being connected.

FIG. 1 illustrates a media handling unit illustrated generally as 2 and an associated photoplotter 4 which receives media from the unit 2 and exposes on such media a graphic in accordance with data maintained electronically in memory. The photoplotter is a drum type photoplotter which employs a partially cylindrical support surface 6 and a scanning mechanism 8 to effect controlled exposure of the media on selected areas thereof. While the unit 2 is capable of being used with many types of drum plotters that are presently in the marketplace, in the illustrated embodiment, the photoplotter 4 is one such as disclosed in the aforemention co-pending U.S. patent application Ser. No. 07/839,398, sold by Gerber Systems Corporation under the tradename CRESCENT/30. Included as part of the handling unit 2 is a central controller 5 which is responsible for switching the drive motors, valves, etc. of the unit between on and off conditions. The controller 5 is capable of being interfaced with the plotter 4 through the intermediary of a personal computer 7 so that the handling operation of the unit 2 can be coordinated with the scanning operation of the plotter 4 to effect succesive scans of a supply of media held in the handling unit 2.

The photoplotter 4 is enclosed by a housing except for being open at its front end for the purpose of allowing the media to be placed onto the support surface 6 and removed subsequent to scanning. The media handling unit 2 has a generally box-like shape as defined by a frame 20 and is enclosed on all sides by a metallic housing 10 which is secured to the frame 20 for the purpose of maintaining the unit in a light-tight condition when loaded with a supply cassette and collecting tray as will be described in greater detail later. The unit 2 is mounted on roller supports 12 which allow it to be wheeled up to the photoplotter for the purpose of connecting with it to create a light tight media handling environment.

Figure 2:
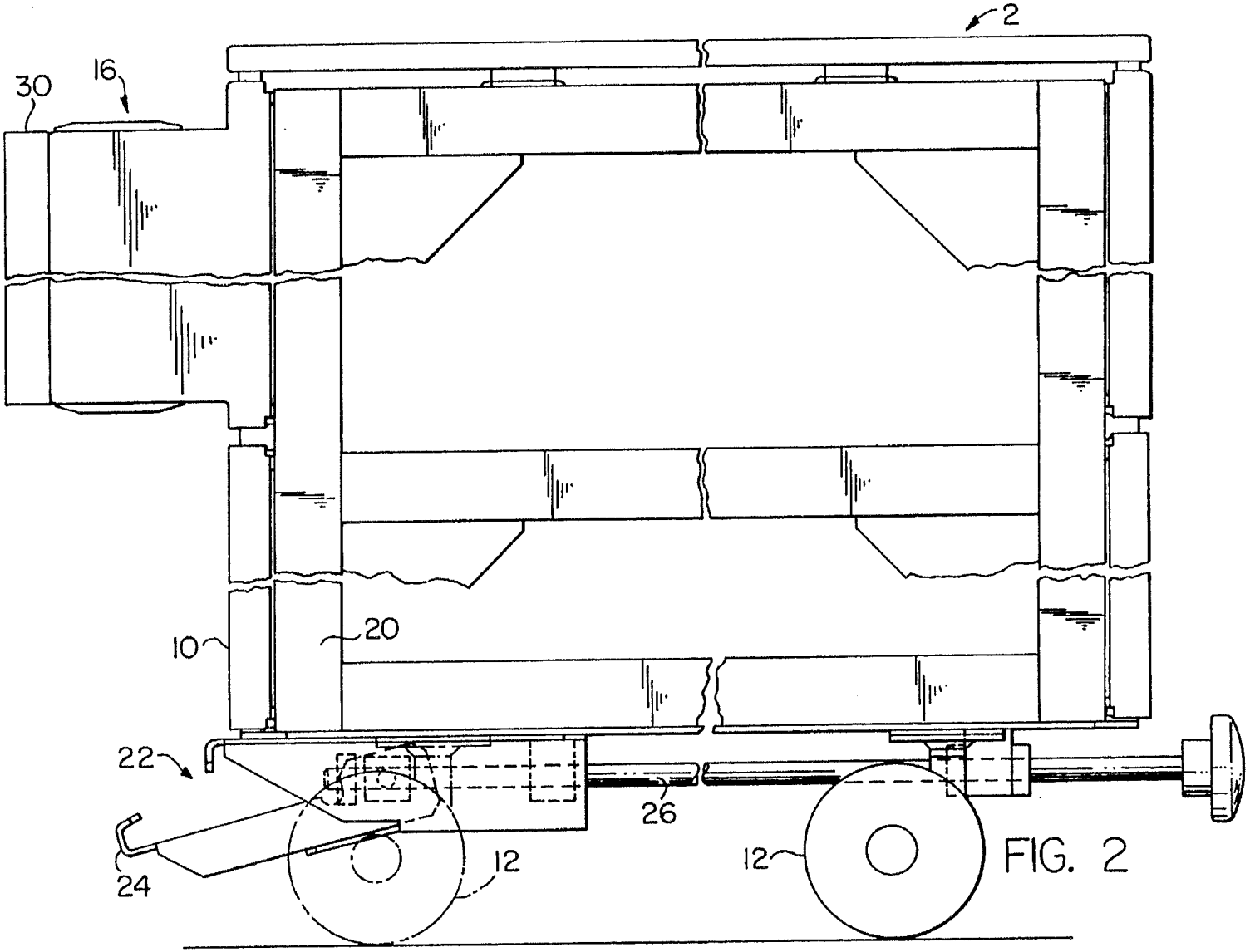
FIG. 2 is a partially fragmentary side elevation view of the handling unit shown in FIG. 1.

Formed in the housing 10 is a supply cassette opening 14 located at one end of the unit and a bridging tunnel 16 located at the end of the unit opposite the opening 14. The bridging tunnel, as best illustrated in FIG. 2, is effectively an extension of the housing 10 and is provided for the purpose of creating a light-tight tunnel between the open end of the plotter 4 and the unit 2 through which media and an extension of the handling system travel. The housing is further provided with a third opening 18 located on one side panel of the unit through which a collecting cassette is received to remove the scanned media.

As mentioned, the unit is capable of being releasably connected to the photoplotter 4 to prevent relative movement therebetween. For this purpose, a latch means 22 is provided at the base of the frame 20 and includes a sliding jaw member 24 which is caused to move between the illustrated open position and a closed condition wherein it is drawn toward the unit through the intermediary of a threaded take up member 26. The jaw member 24 is adapted to engage the lower edge of an elongate pedal 28 or other transversely extending structural member disposed on the plotter 4 for the purpose of clamping it and pulling the media handling unit and the photoplotter together. To effect a light-tight seal therebetween, the bridging tunnel 16 is provided with a yieldable material 30 disposed about the perimeter of the tunnel which engages the outwardly disposed face of the plotter and is caused to sealingly press against this face as the take up member 26 is rotated.

Referring now to FIGS. 3–7 and to the particular structure of the handling system housed within the unit 2, it should be seen that the system is effectively suspended on the frame 20 above a supply station A and a collecting station C which are supported by a subframe member 32 comprising part of the frame 20 and is capable of extending in part outwardly of the frame to an intermediate station B disposed above the plotter surface 6. For purposes of clarity, the supply cassette and the collecting tray which are respectively associated with stations A and C and which are usually in place at these stations during a scanning operation are not shown in FIGS. 3–5.

In addition to the frame 20, the handling system includes a set of support rollers 34,34 rotatably mounted to the frame through a subframe member 72, a sliding U-shaped rack 36 adapted to slide relative to the frame through the intermediary of the support rollers 34,34, and a drum carriage 38 including a vertically moveable positioning drum 40, disposed on the rack for linear movement relative thereto through the intermediary of a set of locating rollers 42,42 disposed on the carriage 38. The U-shaped rack 36 is controllably linearly by driven relative to the frame by a first drive means 44 which includes a first drive motor 46 secured to the frame 20 generally at one end of the unit and a return pulley 48 disposed at the other opposite end of the unit drivingly coupled to one another by a toothed belt 50 which is attached along its length to the rack 36. The drum carriage 38 is controllably linearly moved forwardly and rearwardly along the indicated X coordinate direction relative to the frame 20 and the rack 36 by a second drive means 54 which is comprised of a second drive motor 56 secured to the rack 36 at one end thereof and a return pulley 58 rotatably mounted to the opposite end of the rack and drivingly connected with the drive motor 56 through the intermediary of an endless toothed drive belt 60 secured against movement along its length to the drum carriage 38. It is noted that the distance separating each drive motor and its respective return pulley generally defines the range of travel of the member driven by that motor.

Figure 5:
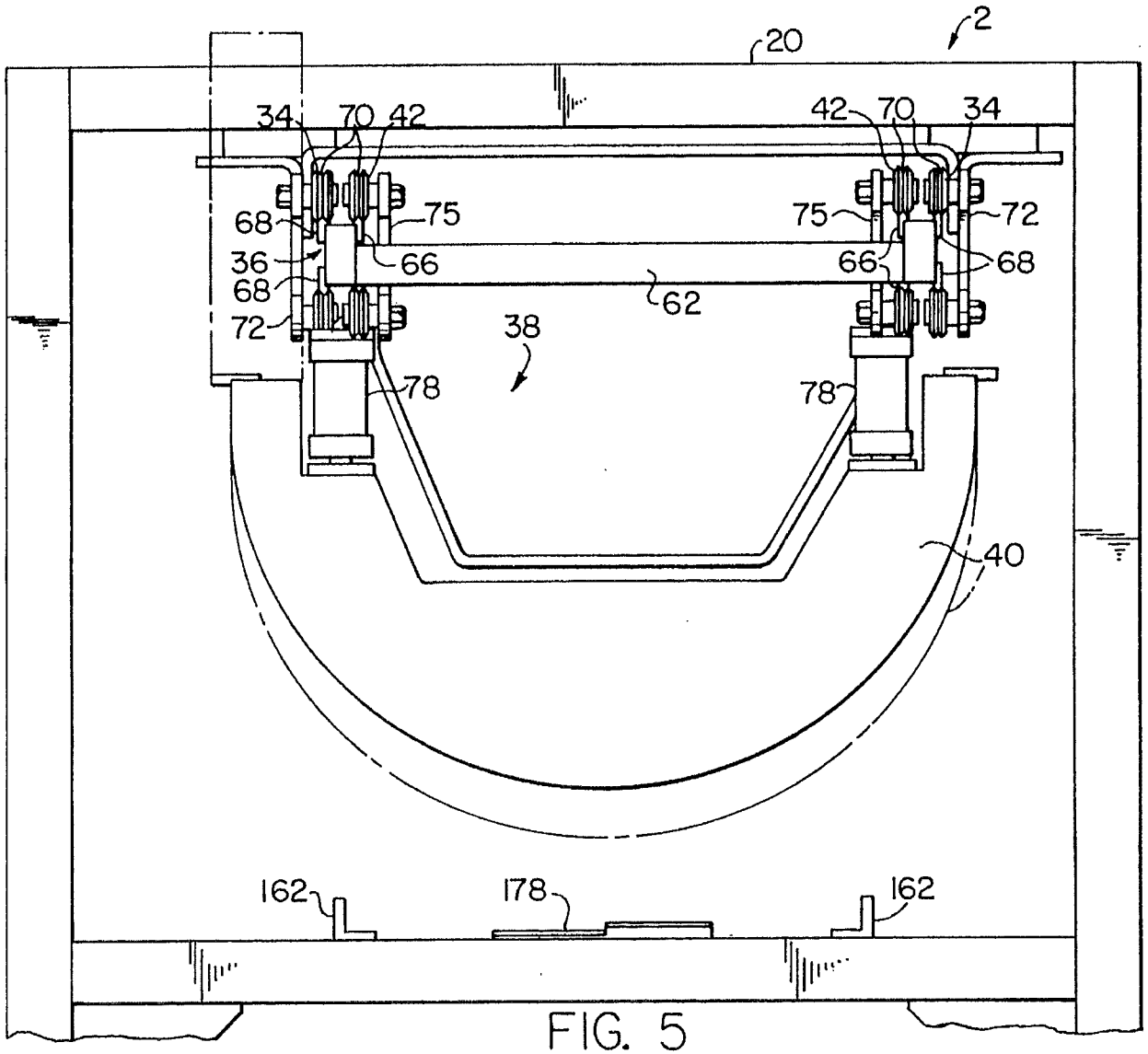
FIG. 5 is a front elevation view of the handling system shown in FIG. 4 looking at it from the left.
Figure 6:
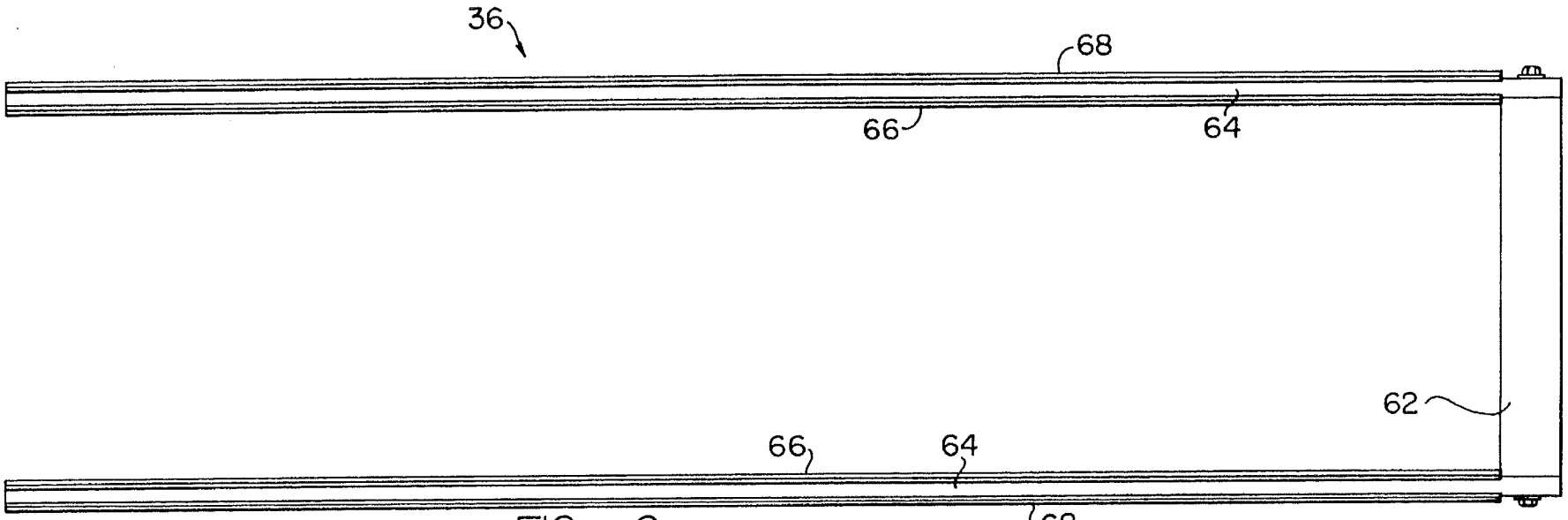
FIG. 6 is a top plan view of the moveable mounting rack shown separately of the system.
Figure 7:
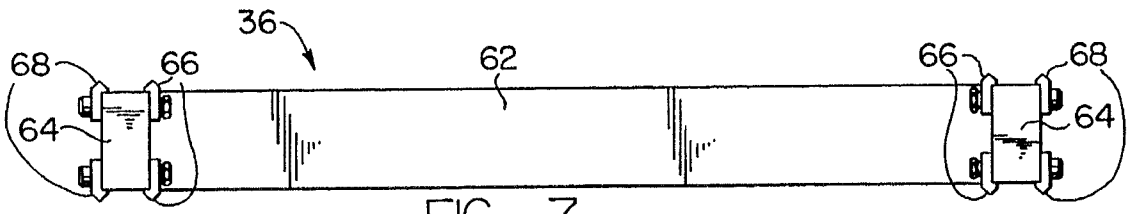
FIG. 7 is an end view of the rack shown in FIG. 6.

As best illustrated in FIGS. 6 and 7, the rack 36 as mentioned is a generally U-shaped member having a transverse part 62 extending laterally between two opposed rails 64,64 and maintaining them in spaced transverse relationship with one another. Each of the rails 64,64 is provided with an inwardly oriented pair of vertically aligned tracks 66,66 associated with the locating rollers 42,42 and an outwardly oriented pair of vertically aligned tracks 68,68 associated with the support rollers 34,34, which inwardly and outwardly oriented tracks being spaced from one another by about the thickness of the rail associated with them, with the top and bottom edges of the tracks of opposed pairs being respectively horizontally aligned with one another. The edges of the outwardly and inwardly oriented tracks 68,68 and 66,66, are each sized and shaped to be correspondingly received within grooves 70,70 formed in the support rollers 34,34 and in the locating rollers 42,42. As best seen in FIG. 5, each set of the rollers 34,34 and 42,42 is comprised of four vertically aligned pairs, with the rollers of each pair being vertically spaced from each other by a distance sufficient to receive the associated ones of the tracks 66,66 and 68,68.

In the preferred embodiment, four pairs of support rollers 34,34 are provided and are mounted to the frame 20 through the intermediary of the sub-frame 72 such that two roller pairs are associated with each rail making up the rack 36 and each such two roller pairs being spaced from one another along the indicated X direction by an amount equalling just less than half the total length of the rails thereby providing a stable support from which the rack can be cantilevered in reciprocative directions outwardly from the sub-frame 72.

Figure 8:
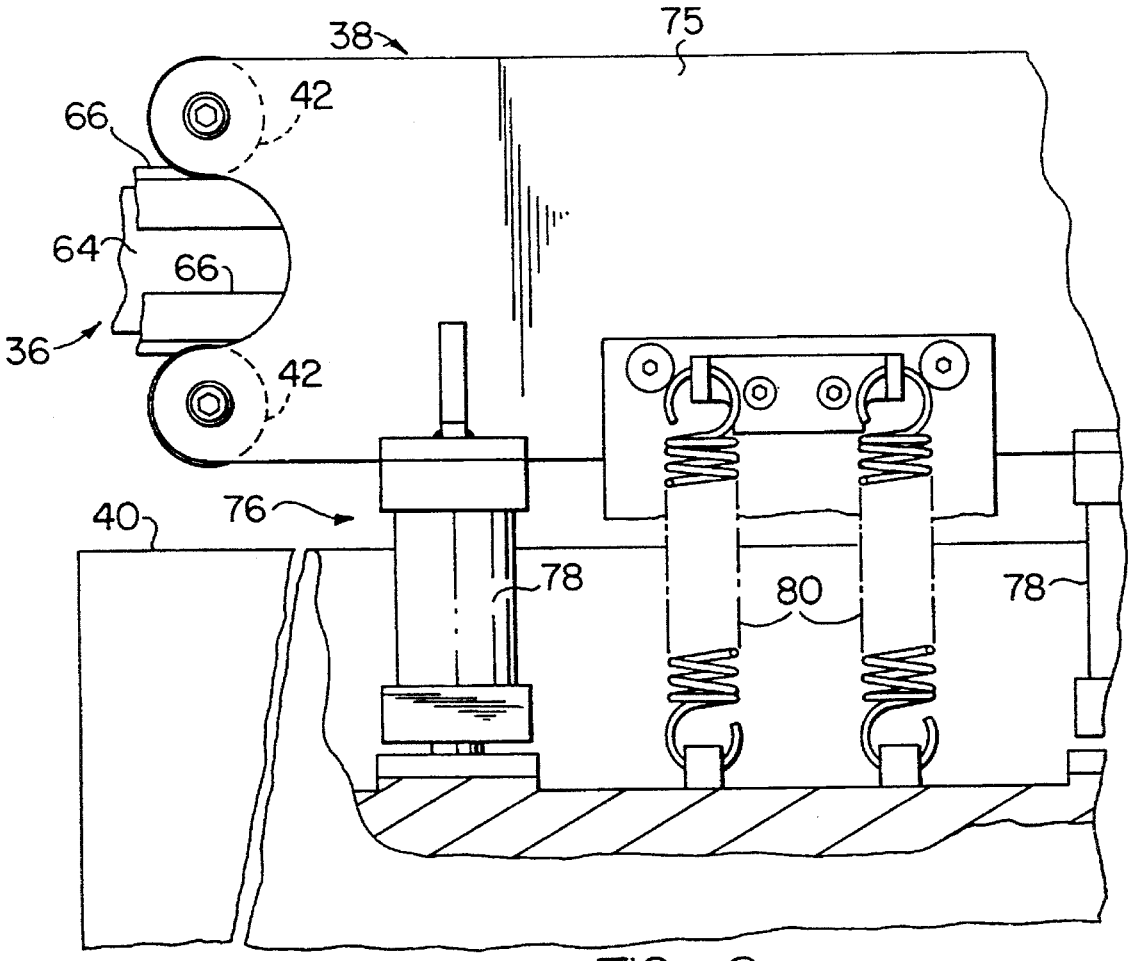
FIG. 8 is a partially fragmentary side elevation view of the media positioning drum.
Figure 9A:
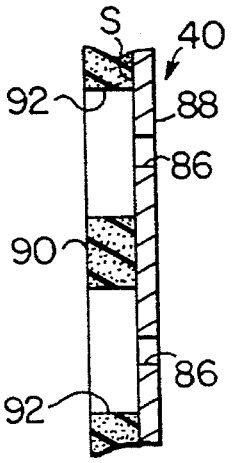
FIG. 9*a* is a partially fragmentary side view through a portion of the media handling drum outer surface.
Figure 9B:
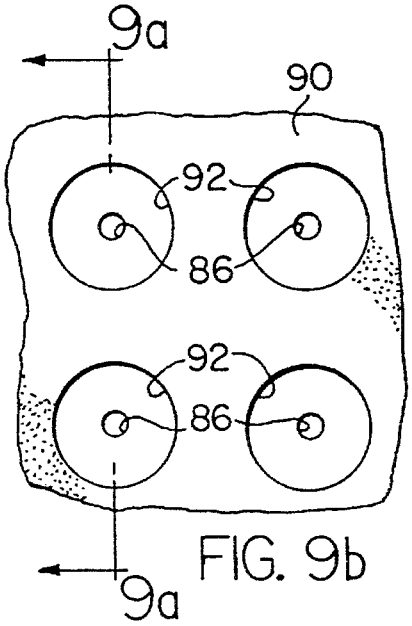
FIG. 9*b* is a partially fragmentary view of the outer surface of the media handling drum.
Figure 10A:
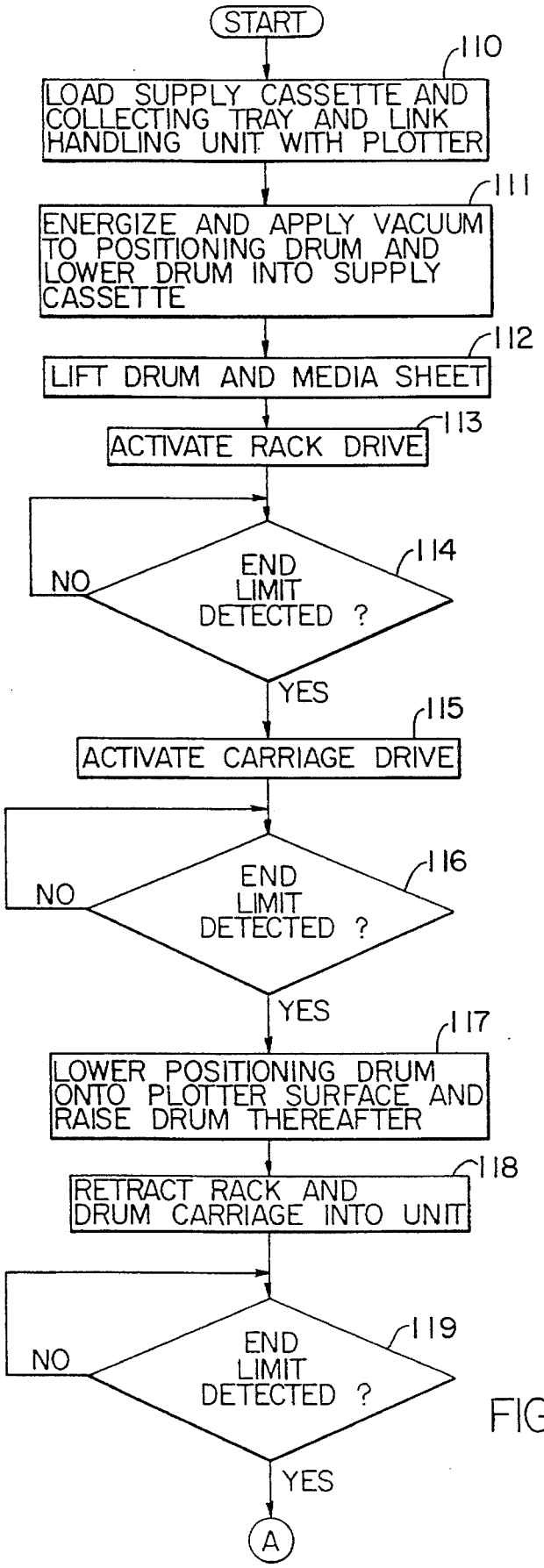
FIG. 10*a* and 10*b* form a flowchart illustrating the handling process.
Figure 10B:
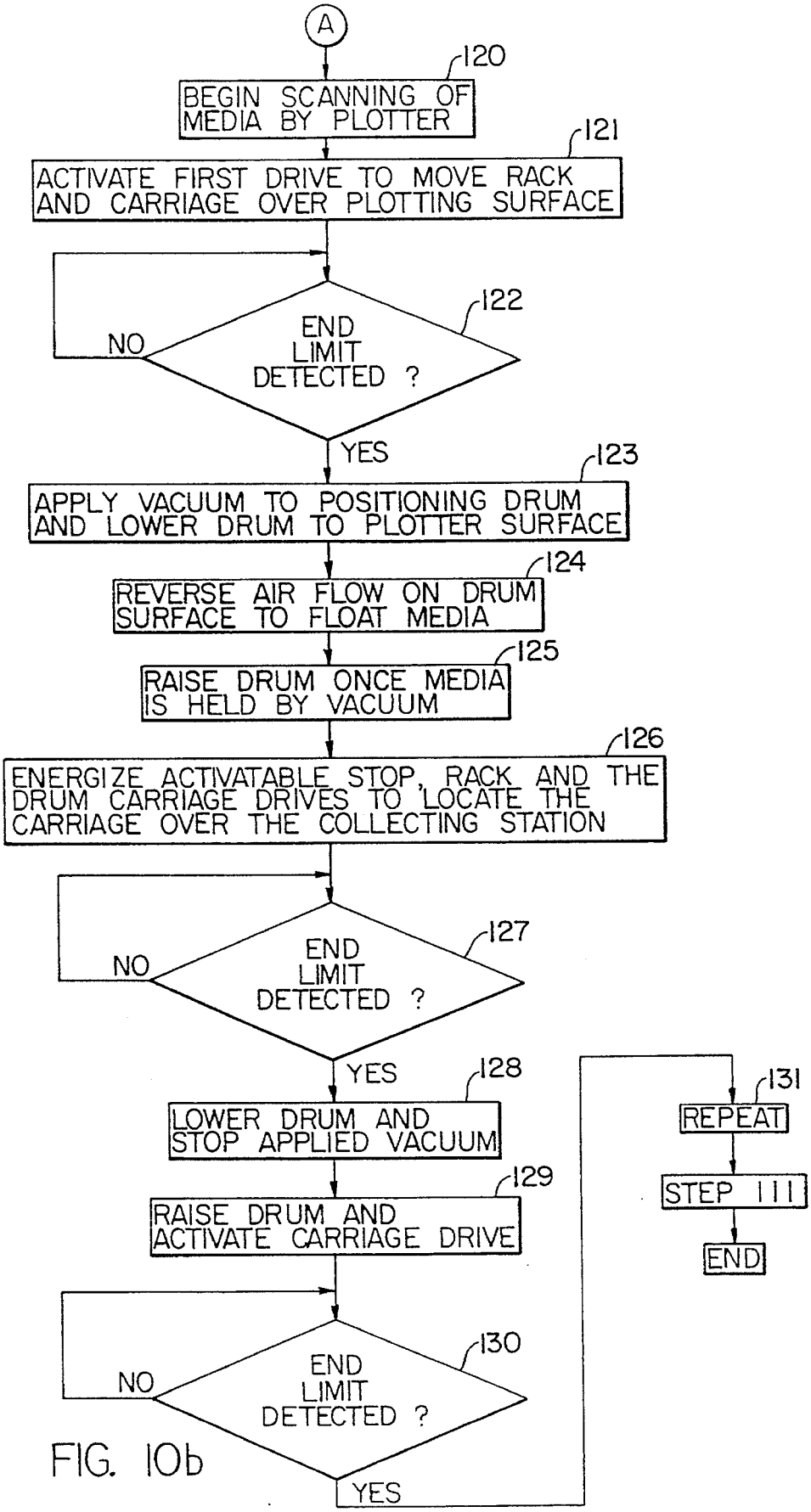

Referring now to FIGS. 5 and 8, and in particular to the drum carriage 38 and the positioning drum assembly carried by it, it should be seen that the assembly includes the positioning drum 40, which is moveable between the indicated vertical up position shown in FIG. 5 and 8 and a vertical down position (not shown) wherein the drum surface is caused to push downwardly against the top most sheet in the supply cassette located at the indicated station A in a manner which will be discussed in further detail with reference to the particulars of the supply cassette. For this purpose, the assembly includes a frame member 75 which makes up part of the carriage 38 and to which frame member are rotatably secured four pairs of the locating rollers 42. The assembly further includes a vertical positioning means 76 interposed between and connected with the frame of the carriage 38 and the positioning drum 40 for controllably moving the drum vertically. This means is comprised of four actuators 78,78 each secured to the frame 75 through a laterally directed member and having a vertically moveable rod connected to the positioning drum. Each of the actuators is connected to a pressurized air supply and the control of such air to the actuators is regulated by a solenoid valve (not shown) which is controlled by the central controller 5 of the apparatus. The actuators 78,78 are double acting and are aided by a plurality of tension springs 80,80 which are interposed between the frame 75 and the mounting drum 40 which act to help return the positioning drum 40 to its illustrated position up condition. These springs also serve to provide a fail safe vertical up condition for the positioning drum in the event that the actuators fail to lift. The drum carriage 38 is linearly moveable along the innermost tracks 66,66 of the rails 64,64 through the intermediary of the four pairs of vertically spaced locating rollers 42,42 that are mounted to the frame 75 and act on the tracks 66,66 at spaced points further adding to the overall stability of the system.

The mounting drum 40 is provided with means for lifting a single sheet of media M from a supply cassette situated at station A and carrying it under the powered movement of the carriage 38 from the loading end L of the unit to and past the discharged end O of the unit outwardly to the position shown in phantom line in FIG. **4*b* which corresponds to the location directly overhead of the support surface 6 of the photoplotter 4. For this purpose the lifting means includes a vacuum source (not shown) contained within the housing of the unit 2, a conduit 81 connecting the positioning drum 40 to the vacuum source and encased in a cable and vacuum line carrier 82 preventing it from inadvertent puncture and connected to the drum 40 through a connection 84** located generally centrally of the drum to introduce vacuum pressure therein.

The positioning drum 40 is a hollow member and is formed from a light weight material, such as aluminum. As best seen in FIGS. **9*a* and 9*b*, the generally cylindrical outer surface S of the drum 40 is defined by a sheet of material 88 having a plurality of openings 86,86 which are provided to communicate the vacuum evenly from the interior confines of the positioning drum 40 to its outer surface S. These openings are equally spaced at about one inch intervals, and in the preferred embodiment, each has a diameter equal to about one-eighth of an inch. Disposed outwardly and externally of the surface S is a layer of material 90 formed from a somewhat yieldable material, such as foamed polyethylene, in which material a plurality of holes 92,92 are made. The holes 92,92 each have a diameter equal to about five eighths of an inch and are concentric with the openings 86,86 formed in the drum and are maintained in such alignment by a layer of adhesive interposed between the surface S and the interior surface of the material layer 90. This arrangement creates the effect of having countersunk openings which enhance the lifting capability of the mounting drum 40** by further dispersing the vacuum pressure over a greater area.

Figure 3A:
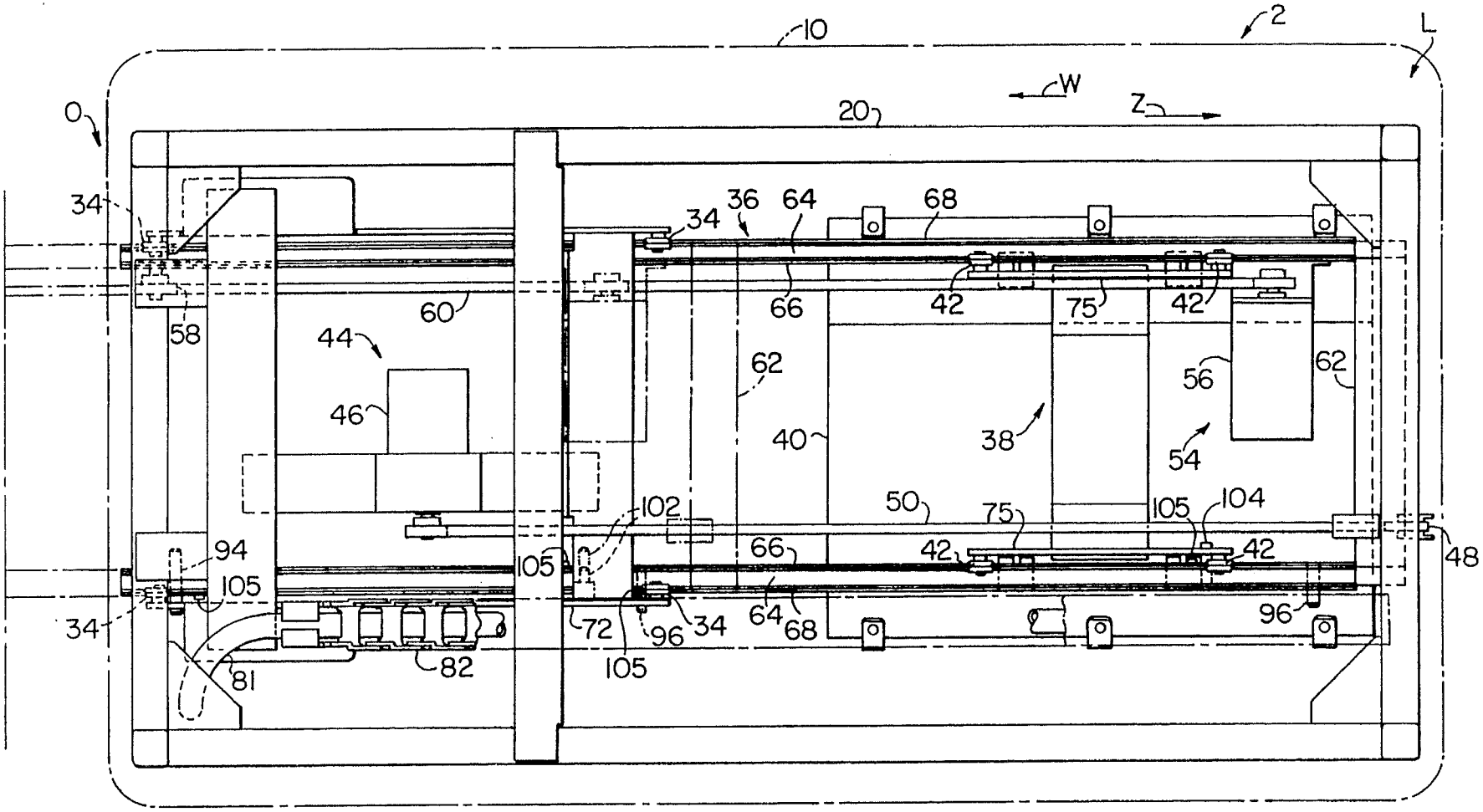
FIGS. 3*a* and 3*b* when placed side-by-side show a top plan view of the media handling system of the unit shown in FIG. 1.
Figure 3B:
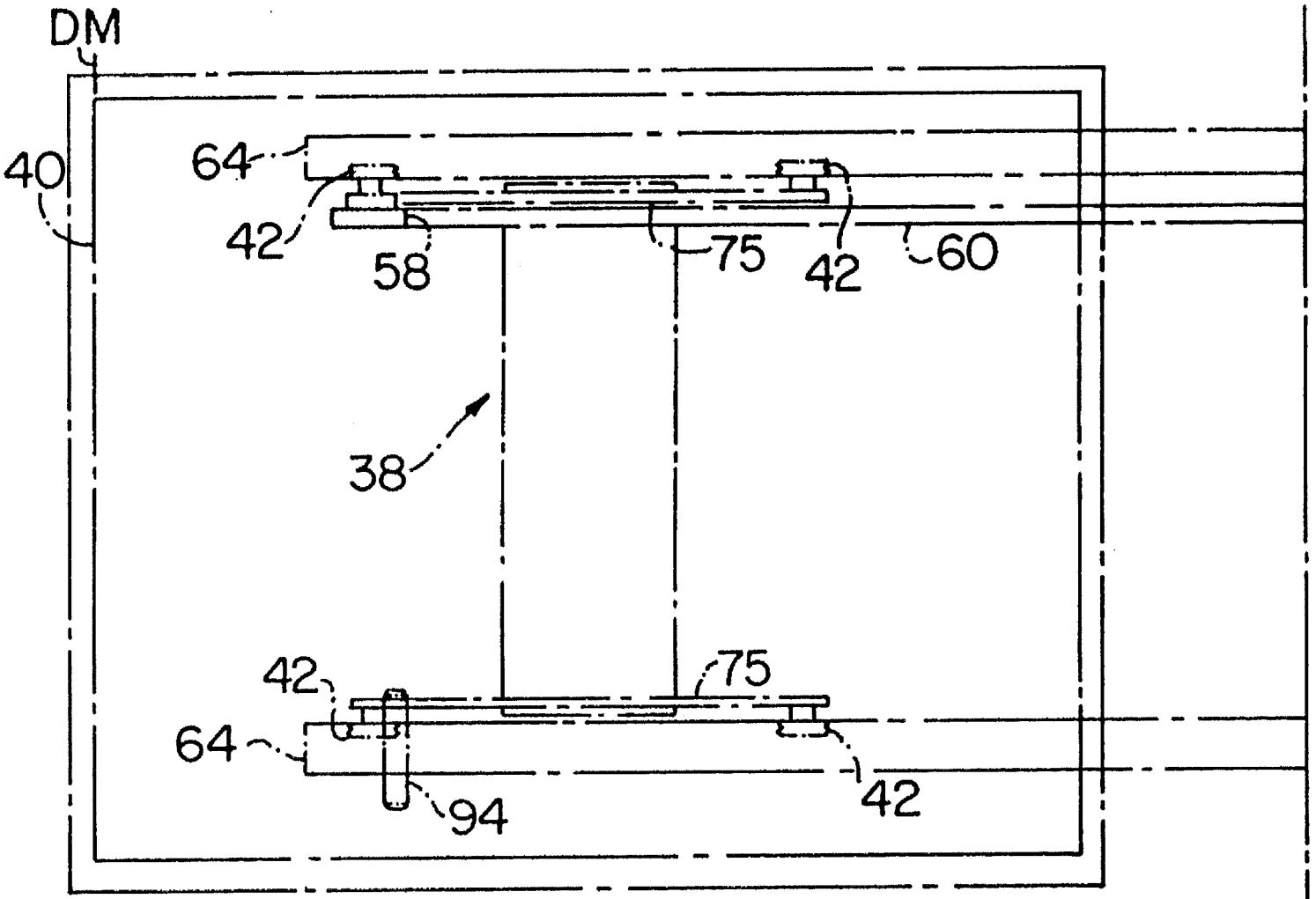
Figure 4A:
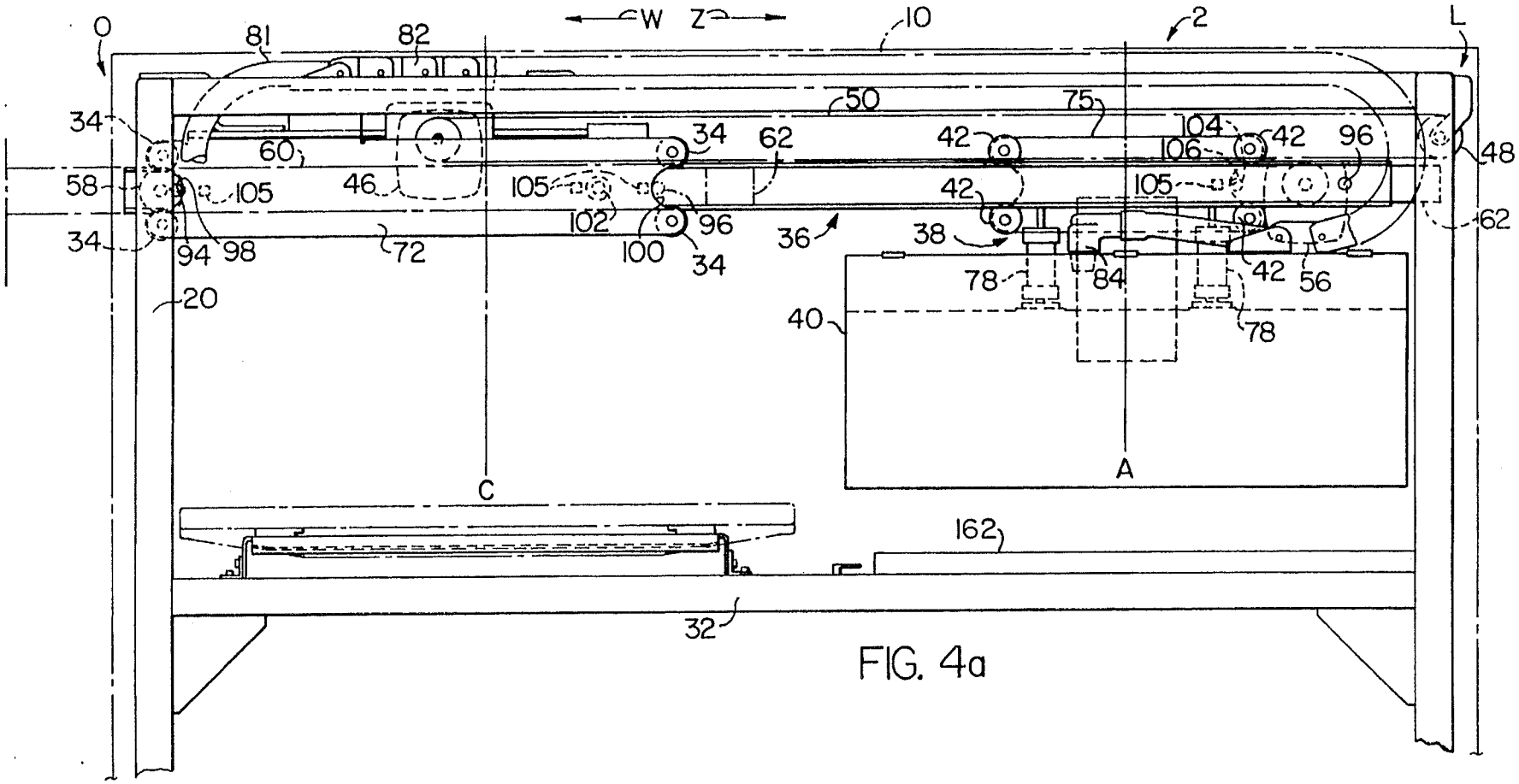
FIG. 4*a* and 4*b* when placed side-by-side show a side elevation view of the handling system shown in FIG. 3 looking at it from the left.
Figure 4B:
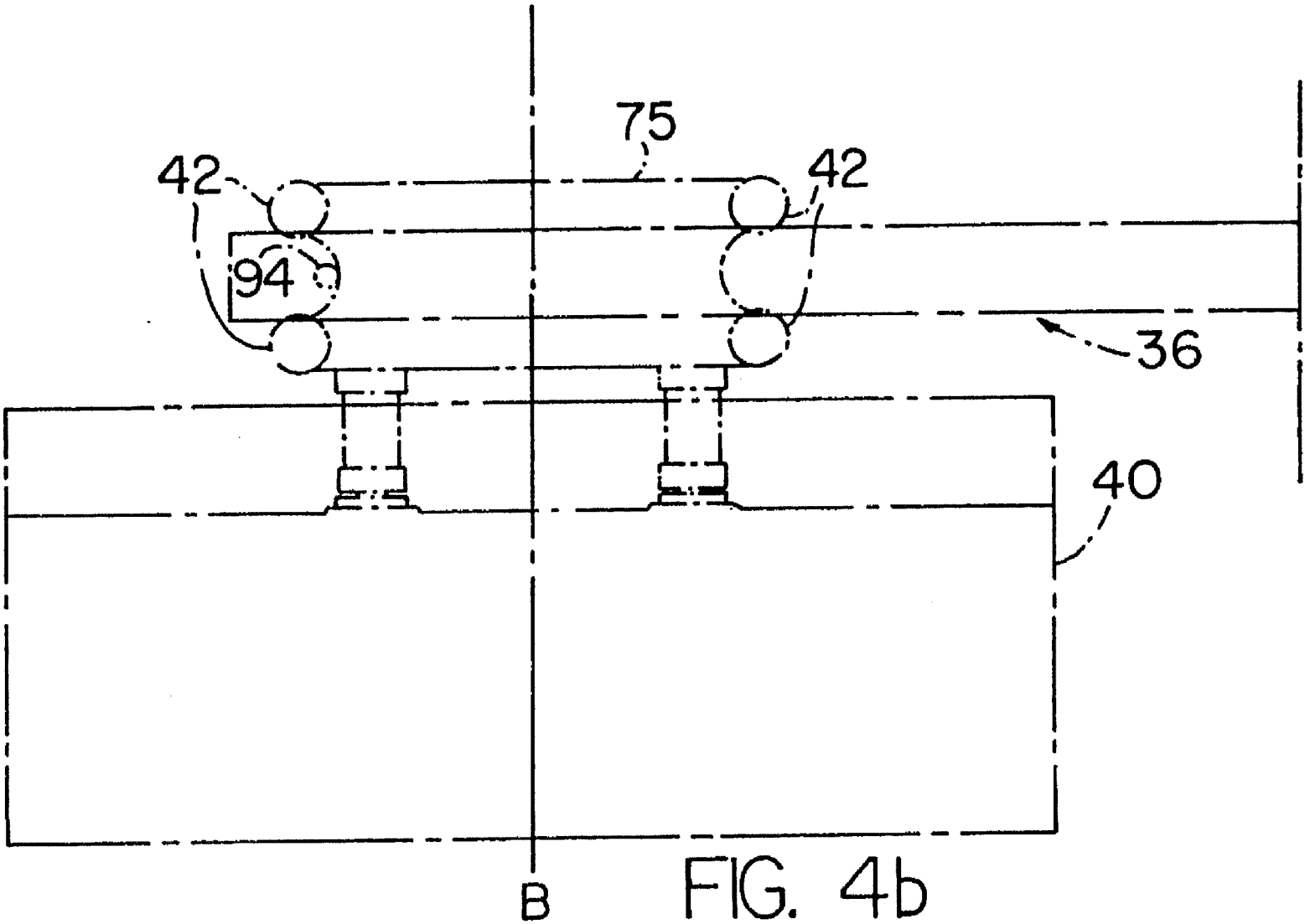

Referring back to FIGS. 3*a*, 3*b* and 4*a*, 4*b* and to the operation of the handling system it should be seen that the system causes the positioning drum 40 to be located at three distinct points for specific tasks in handling of the media M. These locations are defined respectively as station A wherein media is loaded from the supply cassette onto the mounting drum and is thereafter carried in the indicated direction W by the combined movements of the drum carriage 38 and the rack 36 to the intermediate location at station B coinciding with the positioning of the mounting drum directly above and in registration with the support surface 6 of the photoplotter 4, and station C coinciding with the location of the collecting tray wherein the exposed media is dropped from the mounting drum into the tray for subsequent handling. It is noted that in moving a media sheet from station A to station B, the handling system of the invention locates the media sheet M on the support surface 6 in general alignment with a plotting datum DM as illustrated in FIG. 3*b*.

Each of the three stations A,B, and C mentioned above is defined by a travel limiting means associated respectively with the rack 36 and/or the drum carriage 38. For purposes of discussion, it should be understood that labels "Z" and "W" as used herein address particular reciprocative directions taken by the elements of the system along the indicated X coordinate axis. The first such means is provided on one rail of the rack 36 and takes the form of a transverse pin 94 which is located at the end of the rack associated with the end O of the unit. The pin 94 arrests motion of the rack in the indicated rightward Z direction by acting against a stop face 98 on the subframe 72 so as to position the transeverse member 62 of the rack proximate the return pulley 48 at the loading station A. The stop 94 also serves the purpose of arresting the linear leftward motion of the drum carriage 38 as it travels to its final outward location above the plotting station B. A second such stop means is provided on the other end of the rack associated with the loading end L of the unit. The second means takes the form of a bumper indicated schematically as member 96 and acts against a stop surface 100 provided on the frame sub-assembly 72 to arrest movement of the rack in the indicated leftward direction W to position it in its cantilevered orientation as shown in phantom line in FIG. 4*b*.

Motion of the drum carriage 38 in the indicated Z direction is arrested to locate the carriage at the collecting cassette station C by an activatable stop 102 mounted to the frame sub-assembly 72. This third stop means includes a sliding pin which is normally in a retracted position maintained out of interference with the path traveled by the drum carriage 38 as it moves in the indicated W coordinate direction, but is activated to an interfering position as the carriage moves in the indicated Z coordinate direction to stop at the collecting cassette station C. A forth stop means is provided and is located proximate the end of one of the rails 64, 64 associated with the loading end L. This means takes the form of a transversely extending pin 104 extending inwardly from its associated rail and engages a rearward stop face 106 of the drum carriage 38 to arrest carriage movement along the rack 36 in the indicated Z direction thereby repositioning the positioning drum 40 at the supply station A.

To aid in the motion arresting process, sensors 105,105 are provided along the travel line of the rack and the drum carriage to sense the presence of the involved moving member prior to its engagement with the appropriate mechanical stop. Once detected the central control unit 5 of the unit automatically curtails power to the respective one of the drive motors 46 and 56 such that from the point of first detection to actual engagement with one of the mechanical stops, the articulated member moves under momentum forces only, which in the preferred embodiment is a distance equalling to about one inch.

In operation, a supply cassette is loaded into a unit through the supply cassette opening 14 and is thereafter uncovered in accordance with one aspect of the invention which will hereinafter be disclosed in greater detail. At the same time an empty receiving cassette is also loaded into the handling unit through its opening 18. Communication links between the plotter 4 and the handling unit 2 are then established to coordinate the plotting and handling operations with one another. (Step 110) Thereafter, the vacuum source of the unit is activated and the actuators 78,78 are energized to move the positioning drum 40 down into the supply cassette whereupon the top sheet of media is drawn onto the drum by the combined downward applied force of the drum and the simultaneously applied vacuum pressure. (Step 111) The actuators 78,78 are reverse energized and the drum, through the intermediary of the tension springs 80,80 and air pressure is drawn to its vertical up position. (Step 112) Then, the first drive motor 46 is activated and is caused to rotate such that the rack is moved in the indicated direction W until the bumper 96 approaches the stop surface 100. (Step 113) As such approach is made, the sensor 105 associated with the involved stop senses the nearing approach of the end bumper 96, and through this detection the central control unit stops the supply of power to the first drive motor 46. (Step 114) With the sensing of the end of travel of the rack in the indicated W direction, the central control unit then activates the second drive motor 56 such that the drum carriage 38 is moved outwardly of the interior confines of the handling unit and along the now outwardly cantilevered portion of the rack 36. (Step 115) Once the drum carriage reaches its end of travel destination (Step 116) a vacuum source associated with the plotter 4 and communicating with the support surface 6 is applied. Thereafter the vertical actuators 78,78 are energized thus lowering the positioning drum downward so as to locate the media in close proximity with the support surface 16 of the plotter. Thereafter, the applied vacuum to the positioning drum 40 is stopped, the media sheet is released from its holding engagement with the drum and the drum is moved to its vertical up position with the media sheet being held to the platter support surface 4 by the applied vacuum of the plotter 6. (Step 117) The first driving motor 46 is energized such that the rack 36 with the drum carriage still positioned at its outer limit is moved in the indicated direction Z to retract both it and the extended portion of the rack so as to locate the carriage at the intermediate station C. (Step 118) The ones of the sensors 105,105 associated with the stop 94 and the activatable stop 102 are interrogated to determine whether the retraction process is complete. (Step 119) Once the travel limit is detected, the central control unit 5 indicates to the photoplotter that plotting operation may commence. (Step 120) After a plotting operation is completed on a given media sheet, the first drive motor 46 is activated and the rack 36 is again moved in the indicated W direction to extend it outwardly from beyond the handling unit to again position it over the plotting station B. (Step 121) Once the appropriate signal is generated by the sensor associated with the stop 96 indicating that the rack 36 has moved to its outer most limit of travel (Step 122), vacuum is again applied to the positioning drum 40 and the vertical actuators 78, 78 are again energized, thus moving the drum downwardly into contact with the media lying on the support surface 6 of the plotter 4. (Step 123) Simultaneously with this action, the photoplotter reverses the air flow through its support surface 6 to create a positive pressure thereby floating the media such that the positioning drum can more easily act on it. (Step 124) The actuators 78,78 are then reversed energized and the drum 40 returns with the scanned media to its vertical up position. (Step 125)

The activatable stop 102 is activated and the first and second drive motors 46 and 56 are in sequence activated such that the rack 36 and drum carriage 38 are moved in the indicated Z direction. (Step 126) The order of such movement in its preferred embodiment is such that the rack 38 is moved through its end of travel as defined by the stop 94 and thereafter the drum carriage is caused to be advanced a short distance along the rack to an intermediate location corresponding to a position just above the collecting station C as defined by the stop 102. (Step 127) At this point, the actuators 78,78 are again activated such that the positioning drum is now in its vertical down position and the vacuum source is thereafter stopped thereby releasing the media into the tray below. (Step 128) After this, the drum is moved to its vertical up position and the second drive motor 54 is again activated (Step 129) such that the drum carriage 38 is caused to moved in the indicated Z coordinate direction until it confronts its end of travel limit stop 104 defining its home position. (Step 130) Thereafter, the process is repeated (Step 131) until such time as all the media in the supply cassette have been moved.

Figure 11A:
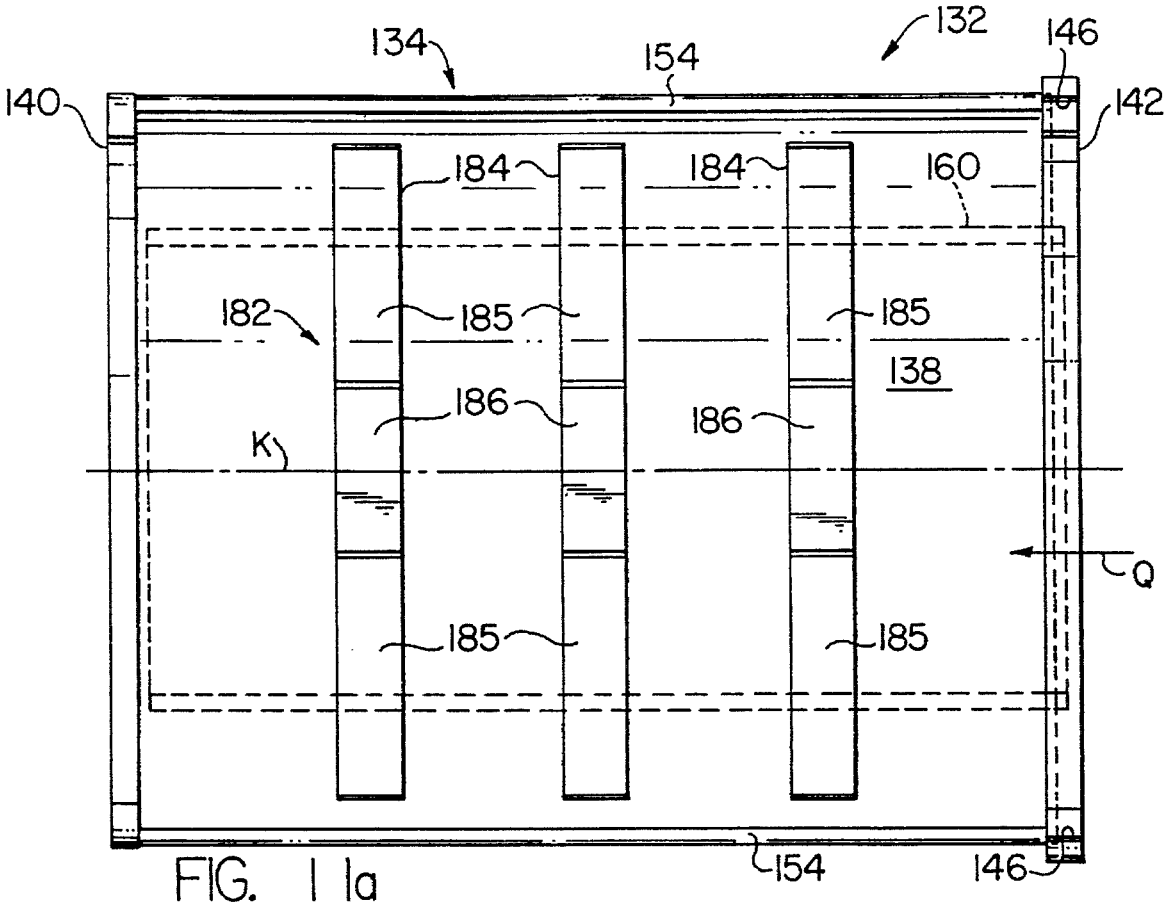
FIG. 11*a* is a top plan view of the supply cassette shown with its cover removed.
Figure 11B:
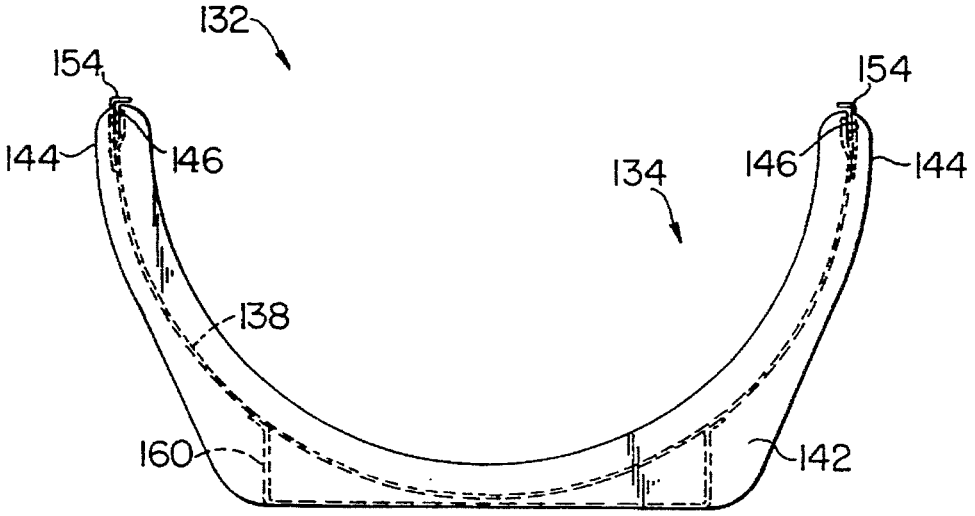
FIG. 11*b* is a front elevation view of the supply cassette of FIG. 11*a* looking at it from the left.
Figure 11C:
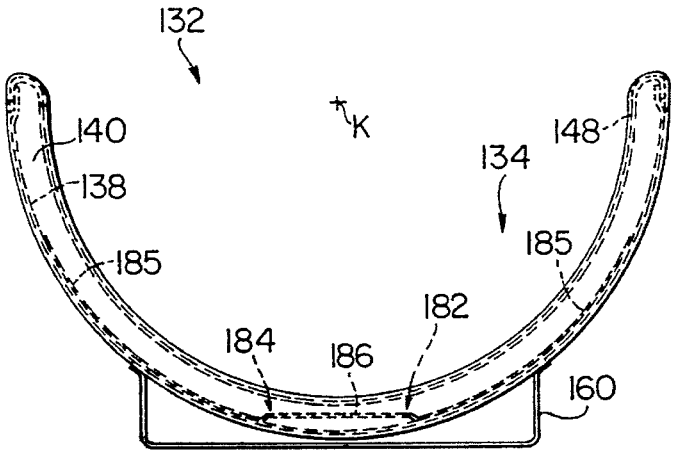
FIG. 11*c* is a rear elevation view of the supply cassette shown in FIG. 10*a* looking at it from the right.
Figure 11D:
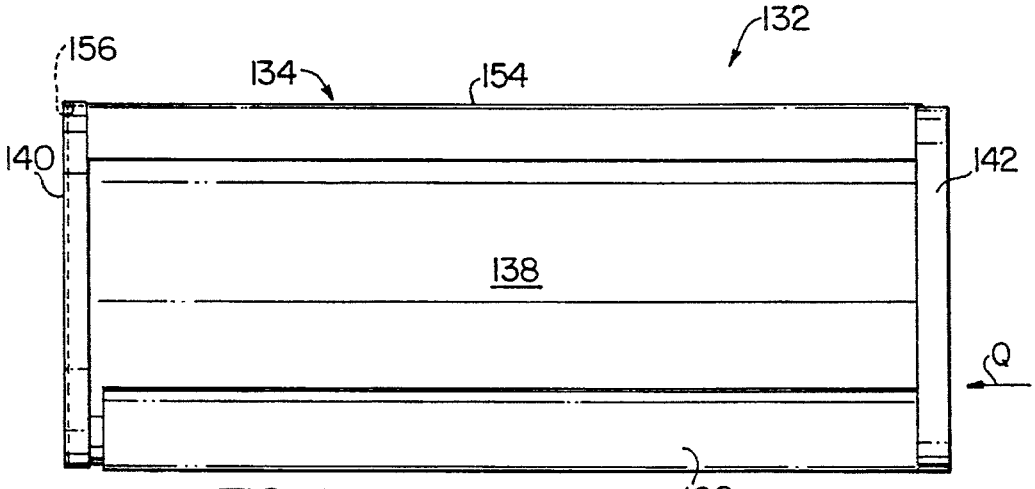
FIG. 11*d* is a side elevation view of the cassette shown in FIG. 11*a* looking at it from its right side.
Figure 11E:
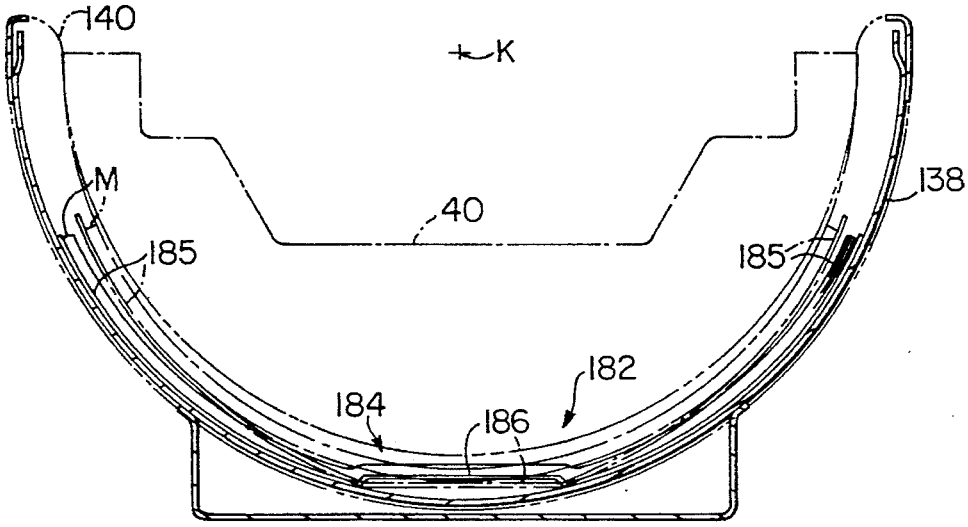
FIG. 11*e* shows the cooperation between the drum and the spring fingers of the cassette during a media lifting operation.
Figure 12A:
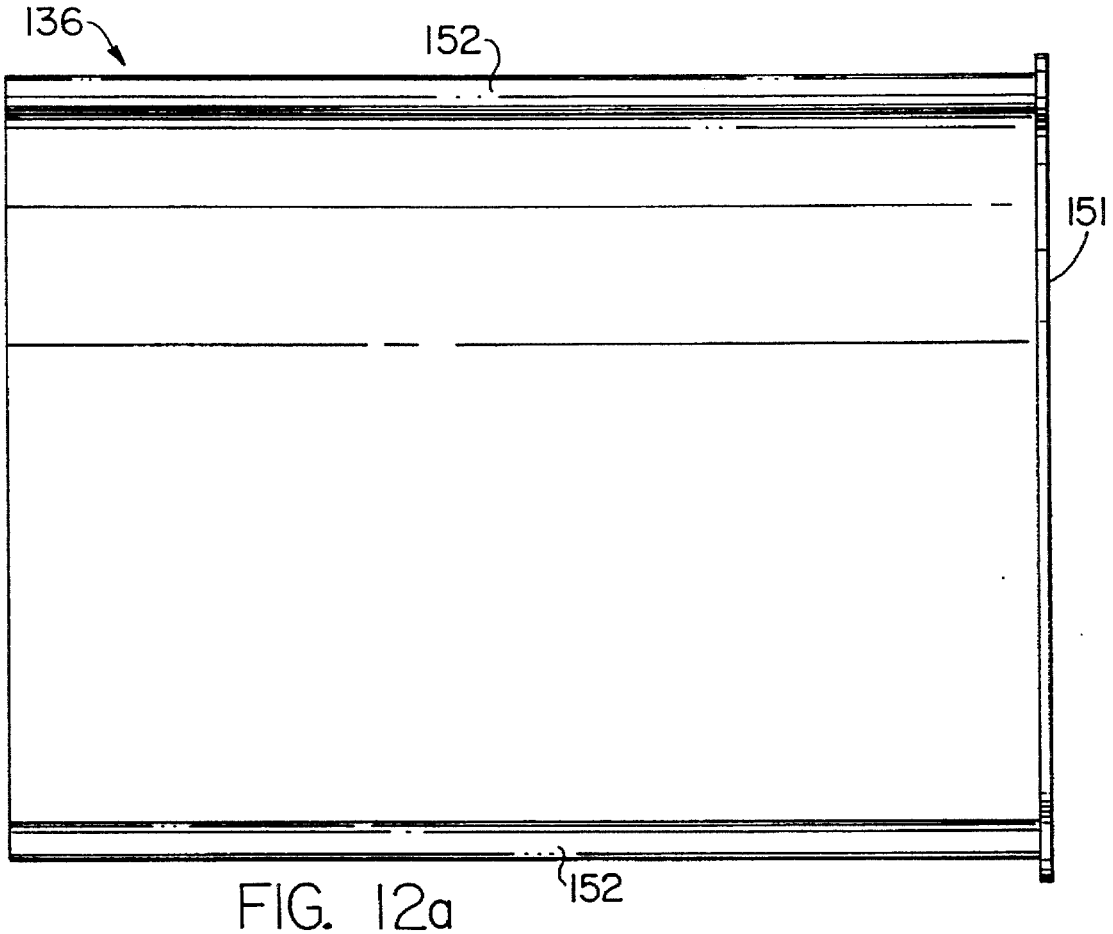
FIG. 12*a* is a top plan view of the cover for the cassette shown in FIGS. 11*a*–11*e*.
Figure 12B:
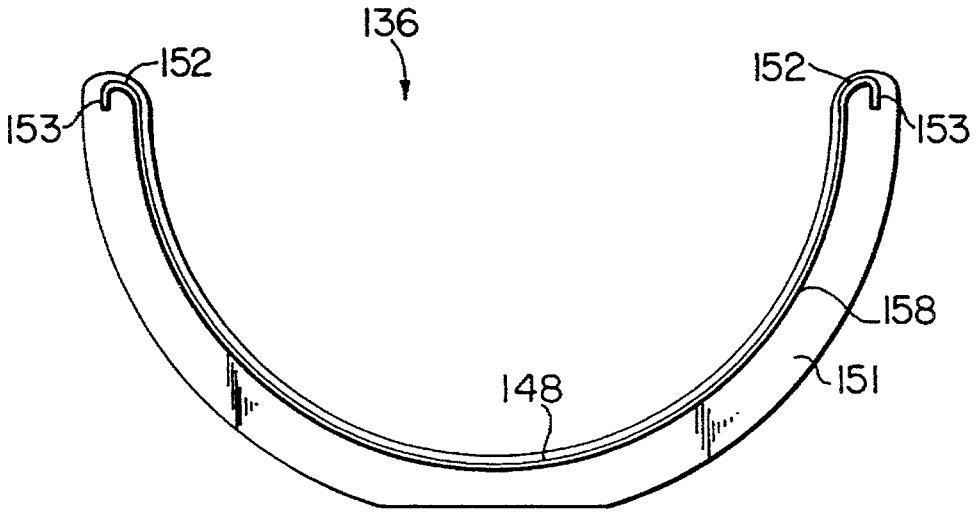
FIG. 12*b* is a rear view of the cover shown in FIG. 12*a* looking at it from its right end.

Referring now to FIGS. 11*a–e* and 12*a–b*, it should be seen that the supply cassette generally illustrated as 132 is a light-tight structure having a two piece construction comprised of a body part 134 shown in FIGS. 11*a*–11*e* and an overlying cover part 136 shown in FIGS. 12*a* and 12*b* engagable with the body part to create a light-tight compartment for storing media until needed. The body part is comprised for the most part of a piece of sheet material 138 which is caused to take the configuration of a half cylindric shape and by a base member 160. The radius of curvature of this sheet is constant along the length of the cassette as taken from a longitudinal axis K and is substantially equal to that of the plotter drum surface 6. This is important since the media which is highly thin and hence flexible, usually on the order of 0.007 inches, is caused to conform to this shape thereby giving it a preform shape for handling while still in the cassette. At opposite ends of the partially cylindric sheet 138 are disposed a first end cap 140 associated with the trailing end of the cassette and a second end cap 142 associated with the cassette's leading end. The supply cassette 132 is supported in a relatively stable condition by the base 160 allowing it to be slidingly received within tracks 162,162 fixed to the frame 20 and accurately positioned relative to the home location of the positioning drum 40.

Both the supply cassette and its cover are complementarily sized and shaped to permit the cover to be readily removed while nevertheless maintaining the light-tight integrity of the compartment during periods of non-use. For this purpose, it should be seen that the cover 136 is likewise formed from a partial cylindrical metallic sheet 148 fixed at right angles to a correspondingly crescent-shaped end plate 151. Further, the cover sheet 148 is outwardly turned at its lateral distal ends 152, 152 while the lateral edges of the sheet 138 which forms the body part of the cassette are complementarily inwardly turned at 154. The outwardly turned edges of the cover sheet 148 provide a track through which the inwardly turned edges of the cassette 132 are slidingly received. This arrangement creates a labyrinth through which light passage is prevented. Further to these ends, the lateral edges of the cover sheet 148 are outwardly turned such that depending portions 153,153 are formed and the opposed end portions of 144,144 of the second end cap 142 have formed in them inwardly directed slits 146,146 which permit the depending portions 153,153 of the coversheet 148 to be slidingly sealingly received within the slits and thereafter positioned around the inturn edges 154, 154 of the body member 134. Additionally the first end cap is mounted to the body part sheet 134 such that a slight clearance 156 exists between it and the inturned edges 154, 154 of the body portion sheet 138. This clearance allows the leading edge of the coversheet 148 to be captured within this clearance upon the continued insertion of the cover into the cassette in the indicated direction Q. As seen in FIG. 12*b* the junction between the end plate 151 and the connected coversheet 148 is lined with a light impenatrable material 158, such as black foam rubber. Additionally, the outturned portions 152,152 of the coversheet and the first and second end plates of the body member are provided with a like light impenatrable strips.

As seen in FIGS. 11*a* and 11*e*, the supply cassette 132 is further provided with a means 182 cooperating with the vertically moveable mounting drum 40 for causing the media to be drawn into engagement with the outer surface of the mounting drum as it is vertically moved downwardly into engagement with it. For this purpose, the means 182 includes a plurality of metal strips or spring fingers 184,184 which are disposed along the upwardly facing support surface provided by the sheet 138. The spring fingers 184,184 directly support the stack of media laid upon them and have a raised central portion 186 integrally connected to end portions 185,185 which curve substantially with the same radius of curvature of the support surface of the body member 134. As best illustrated in FIG. 11*e*, the raised central portion 186 is located generally centrally with the central axis K of the cassette such that the downward action of the mounting drum bears directly on this portion as it is moved vertically downwardly as discussed with reference to FIGS. 5 and 8. The result of this action is the flexure of the end portions 185,185 inwardly toward the mounting drum thereby causing the sheet material to be pressed into engagement with the suction surface of the mounting drum.

This feature is important in the instance where the remaining few sheets in an original stack of fifty media sheets remain in the cassette for handling by the mounting drum 40. That is, for a stack of 50 sheets of 0.007 inch thickness the radius of curvature will vary from the topmost sheet to the bottom most sheet by an amount of approximately three eights of an inch. Since the drum has to be smaller than the minimum radius as defined by the top most film sheet, the action of the metal strips or spring fingers is important in causing the sheets of a greater radius to be moved into engagement with the suction surface of the mounting drum.

Figure 13A:
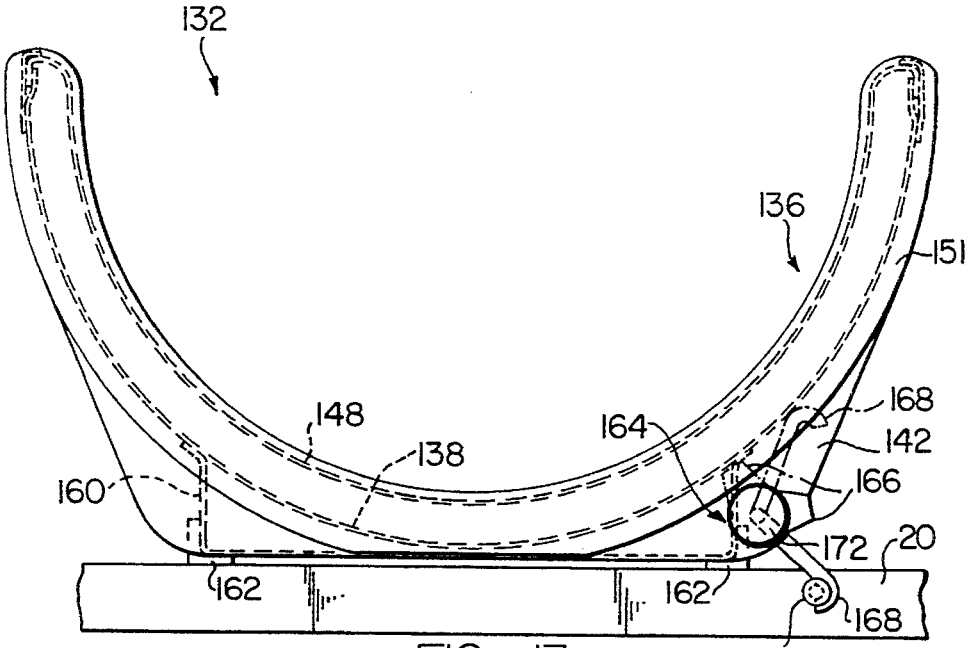
FIG. 13*a* shows the cassette and cassette cover locking mechanism as seen in front end view.
Figure 13B:
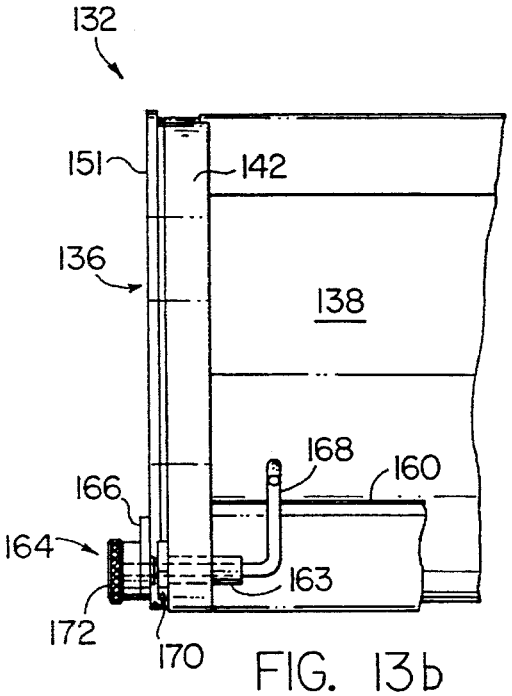
FIG. 13*b* is a side elevation view of the cassette and cassette cover locking mechanism of FIG. 12*a*.
Figure 13C:
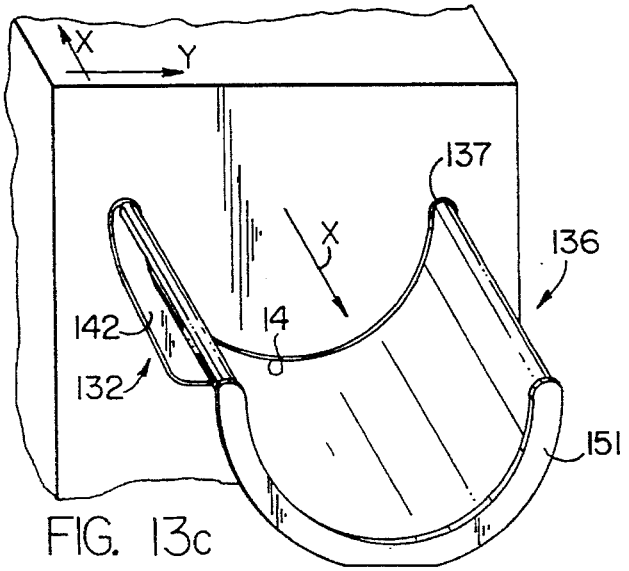
FIG. 13*c* shows the cassette cover being removed from the unit once the cassette is locked in place.

Referring now to FIGS. 13*a*, 13*b*, 13*c* and in particular to the locking mechanism which allows the supply cassette and its cover to be locked against inadvertent removal prior to being placed in the handling unit 2, it should be seen that the mechanism as shown in FIG. 13*a*, is provided on the second end cap 142 and includes a journalling member 163 which inturn receives a locking part 164 capable of being rotated between locking and non-locking conditions. The locking part 164 includes a cam member 166 which is nonrotatably coupled to a latch member 168, which latch and cam members are angularly offset by approximately 45 degrees. In this way, the cam member 166 being spaced from the second end cap 142 by a guide bearing 170 is caused to be rotated in a counterclockwise direction to cause the cam to engage with the outer face of the end plate 151 of the cover member 136 as shown in phantom line.

Likewise shown in phantom line is the position of the latching part 168 which is shown at a one o'clock position. In this condition, the cassette cover sheet and the body are locked against inadvertent removal by the cam member 166, thus making the loading and covering process for the supply cassette capable of being accomplished at an offsite remote location. As shown in solid line in FIG. 13*a* the rotation of a knob 172 which is nonrotatably connected with the locking part 164 causes the camming member 166 to be rotated out of engagement with the end plate cover 151, but nevertheless cause the latch part 168 to engage on a locking pin 174 extending in the direction of guide rails 162 and secured to the frame 20.

Figure 14:
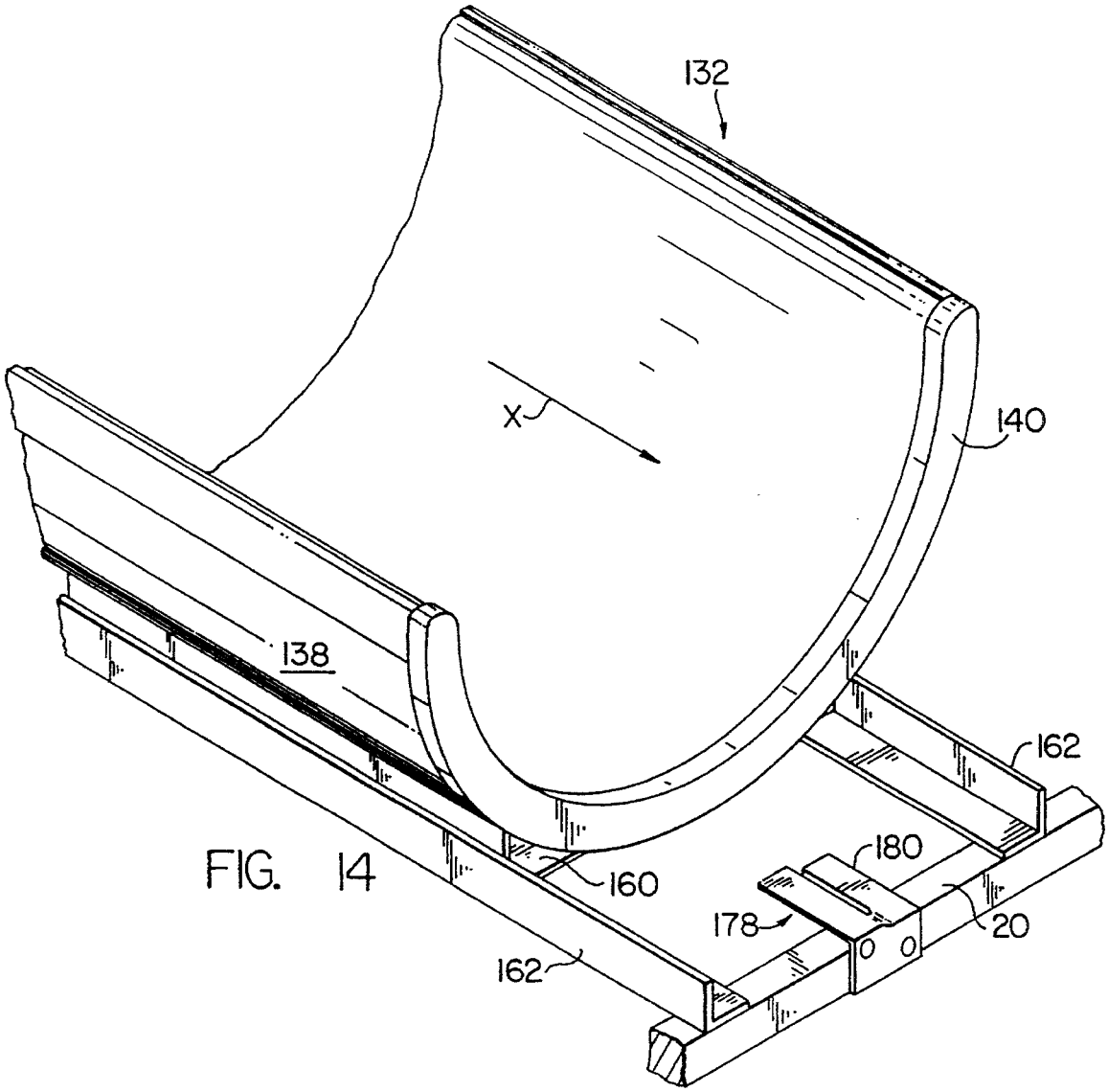
FIG. 14 is a perspective view of the end stop for the supply cassette.

As previously discussed, the base 160 of the cassette assembly allows the cassette to slide into the opening 14 in the housing until the second end cap 142 of the cassette is seated in the opening against the bias of a surrounding continuous seal 137. Thereafter, the locking piece 164 is rotated in a clockwise direction to cause the latch piece 168 to engage with the pin 174 to lock the cassette against movement in the indicated X coordinate direction. In this condition, the cover member 136 is freely slidabily removeable from the body part 134 as illustrated in FIG. 13*c* such that it can be pulled outwardly of the unit while the body and the supply of media remains sealed against light during this uncovering process. The end limit of travel and vertical limit for the supply cassette 132 as it is inserted through the opening 14 in the housing 10 is defined by an end of travel limit piece 178 illustrated in FIG. 14 which is generally L-shaped having its depending portion secured to the frame 20 and having its generally orthgonally directed portion 180 being disposed in the direction of the guides 162,162. The portion 180 has a fork-like configuration which is adapted to be received between the base 160 of the supply cassette and the partial cylindric sheet 138. Thus, with continued advancement of the supply cassette 132 along the indicated X coordinate direction, the second end cap 142 of the supply cassette becomes automatically seated flush with the exterior face of the handling unit.

Referring now to FIGS. 15–19 and to the collecting cassette station C, it should be seen that this station is defined by a loading support 190 having a support plate 192 and laterally disposed guide members 194, 194 defining a support surface F generally aligned with the opening 18 in the housing 10. The collecting cassette associated with the collecting station C and illustrated generally as numeral 200 in FIG. 16*a*, is comprised of a generally rectangular tray having a bottom 202 and long sides 204,204 and short sides 206, 208 defining a generally rectangular characterstic of the tray. Below the tray bottom 202 are provided a pair of guides 210,210 which are correspondingly sized and shaped to be received within the receiving guides 194, 194 of the support plate 192. The guides 210, 210 are chamfered along their leading edges 212, 212 and a guide ramp 213 is provided on the support plate 192, the effect of both the chamfers 212, 212 and the guide ramp 213 serving to facilitate the mating of the corresponding shaped guides as the tray 200 is inserted through the opening 18 along the indicated direction S.

Figure 16A:
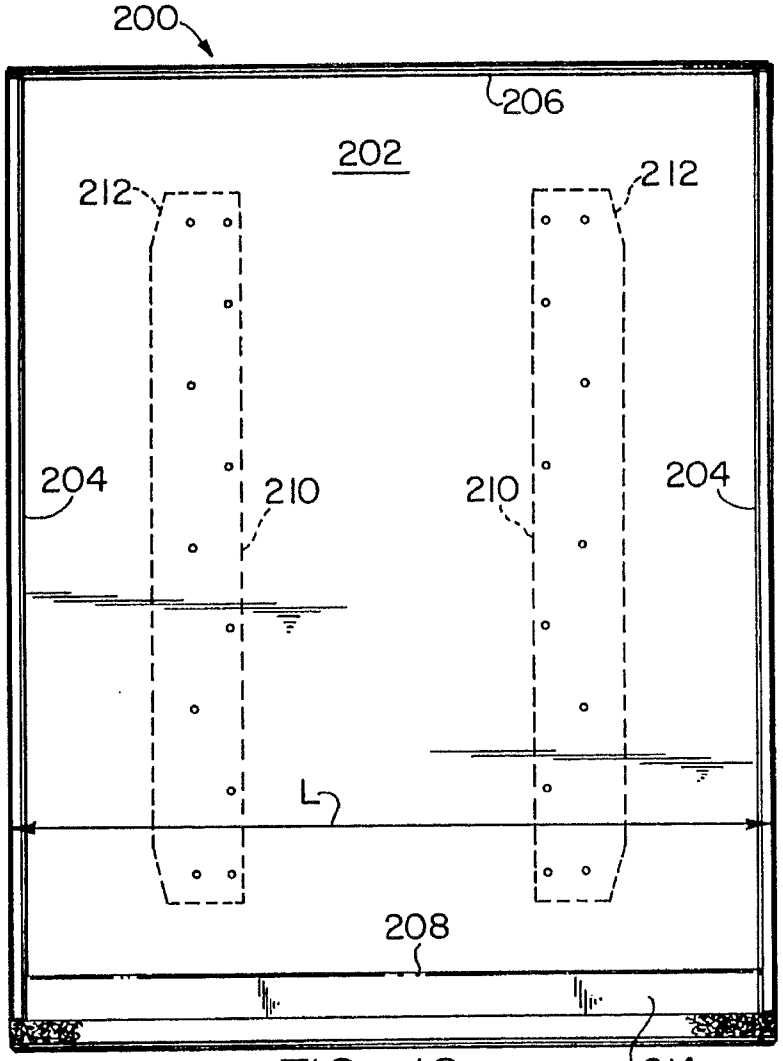
FIG. 16*a* is a top plan view of the collecting tray.
Figure 16B:
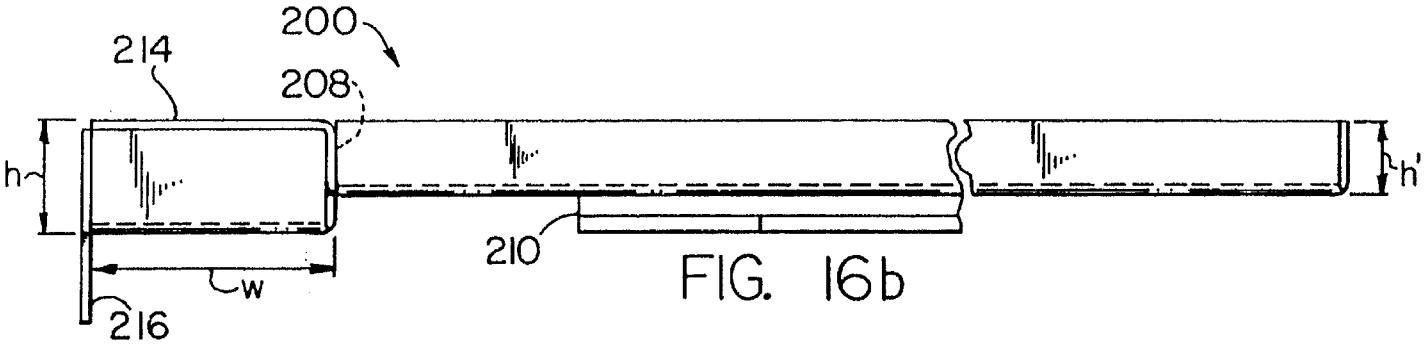
FIG. 16*b* is a side elevation view of the collecting tray shown in FIG. 16*a* with the side sealing strips removed.

As seen in FIG. 16*b*, the short side 208 of the tray 200 is defined by a hollow elongate block 214 which is welded to the trailing end of the tray 200. As is apparent from this figure, the block 214 has a height h equal to about twice the height h' of the tray 200 and the block member 214 has a width W which is sufficient in size to permit it to straddle partially between the interior confines of the housing and the external environment of the media unit when inserted into the unit. The tray is limited in the direction of insertion S by a stop plate 216 which abuts against the housing 10.

Figure 18:
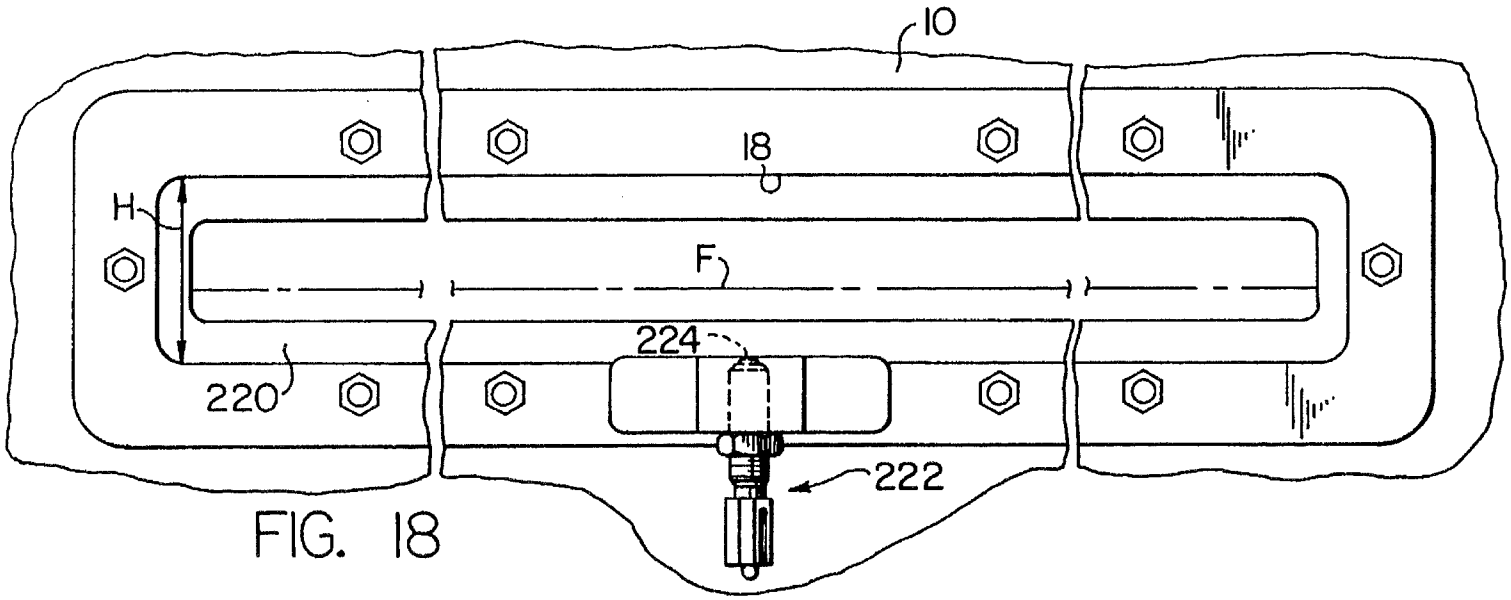
FIG. 18 illustrates the receiving opening formed in the handling unit for receiving the tray and cover.
Figure 19:
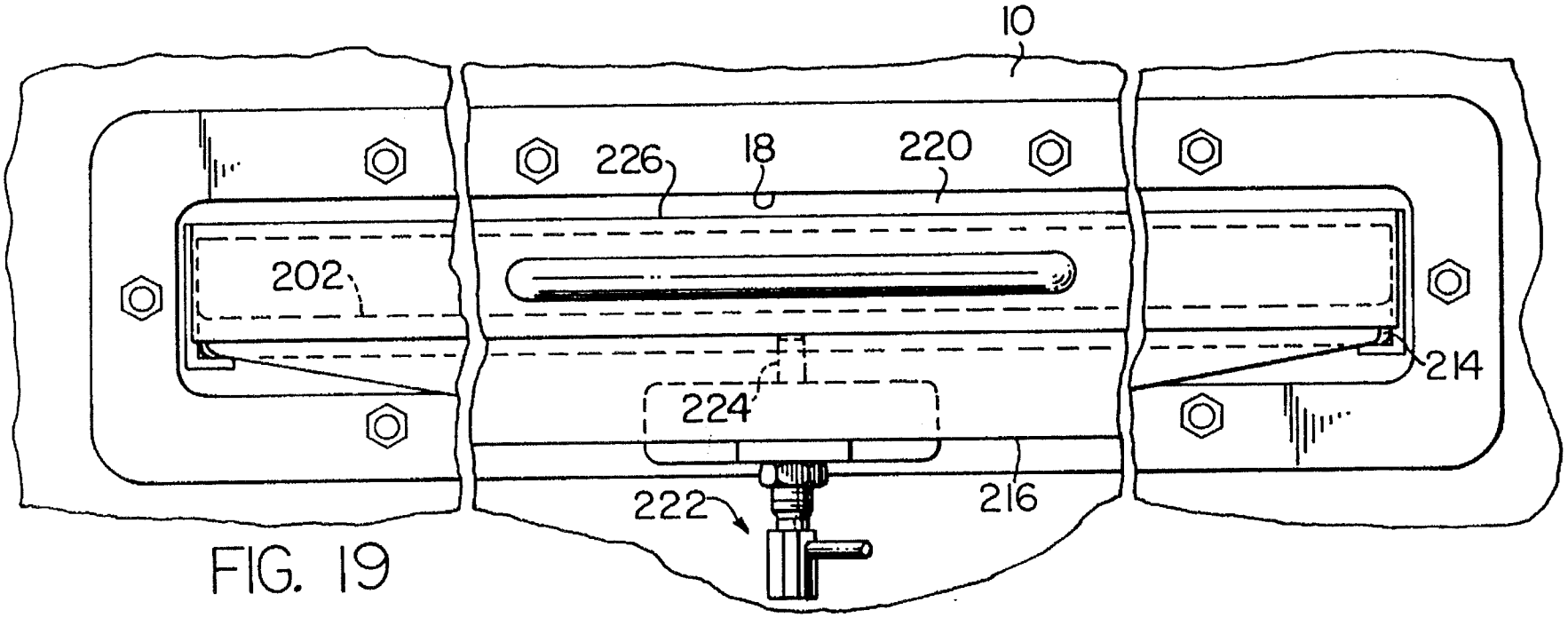
FIG. 19 is a vertical section through a covered collecting cassette as inserted within the opening of FIG. 18.

The support surface F of the plate 192 is disposed relative to the opening 18 as illustrated in FIG. 18 such that it is generally located at one half the opening height H. This is to allow for the generally one half sized relationship between the height h of the member 214 and its associated tray height h' thereby permitting the bottom surface 202 to seat on the support surface F while nevertheless fitting the elongate block 214 squarely within the confines of the opening 18.

The opening 18 is slightly oversized relative to the thickness dimension h and the length L of the tray so that a light enclosing seal 220 can be provided around the perimeter of the opening. The seal 220 is formed from a flexible rubber material and is yieldable to allow the insertion of the supply cassette into the unit while nevertheless being compressed against the outer perimeter of the elongate retangular block 214.

Figure 17:
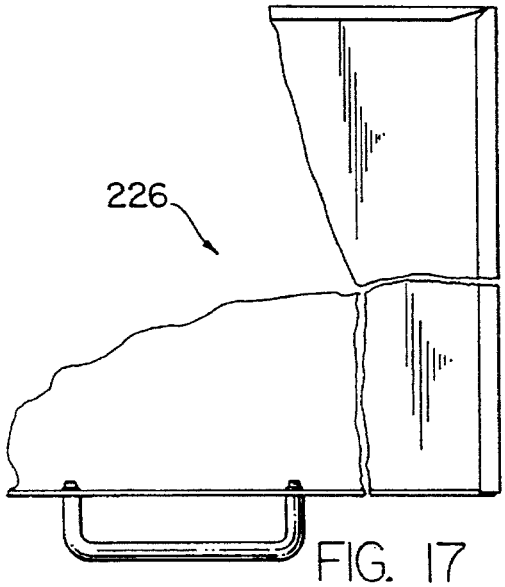
FIG. 17 illustrates the cover for the collecting tray illustrated in FIGS. 15 and 16.
Figure 15:
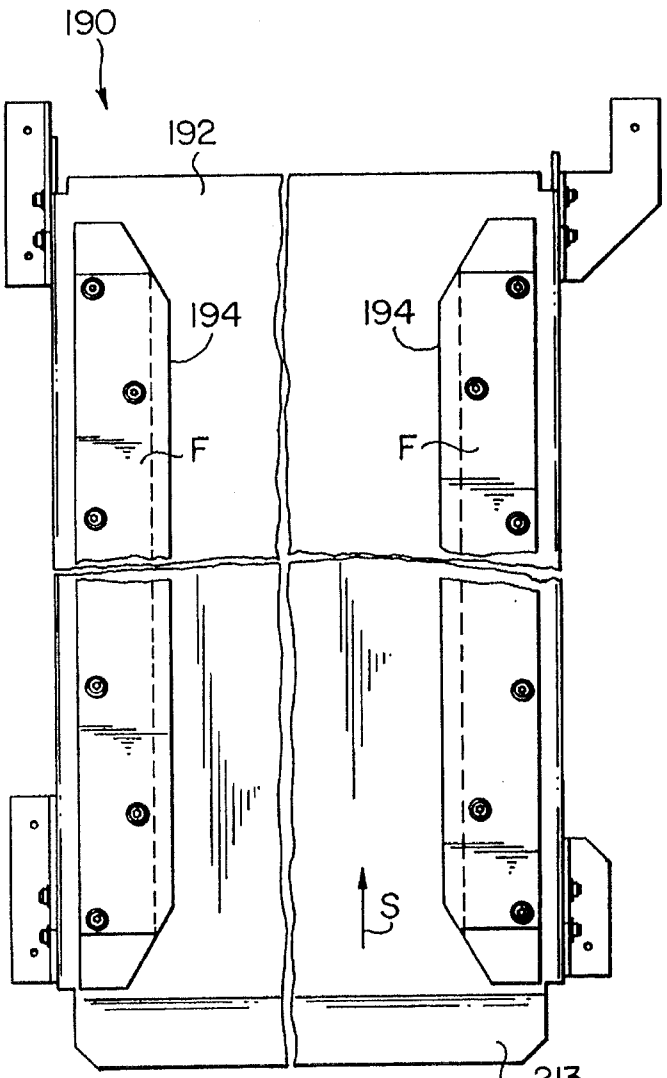
FIG. 15 is a top plan view of the holding support for the collecting tray.

In use, an empty tray 200 is inserted through the opening and is positioned on the support plate 192. For locking the tray into position on the support plate a locking device 222 is provided and includes a reciprocating pin member 224 which is received within a correspondingly sized and shaped opening formed in a lower surface of the rectangular block member 214. After a scanning operation is completed on all the media, a tray cover 226, illustrated in FIG. 17, is slid over the tray 200 between the compression seal 220 and the outer surface of the rectangular block member 214 in a manner shown in FIG. 19. Once the cover is in place the locking member 222 is released and tray is removed by pulling the stop plate 216 together with the tray cover out of the unit.

By the foregoing a media handling system has been disclosed by way of illustrating rather than limitation. However numerous modifications and substitutions may be had without departing from the spirit of the invention. For example, in the operation of the handling system as discussed with reference to FIGS. 3*a*, 3*b* and 4*a*, 4*b* it is disclosed to actuate the drive motors 46 and 36 at separate instances so as to create two distinct movements between the rack member 36 and the drum carriage 38. However, it is within the purview of the invention to accelerate the handling process by driving both motors together where combined movements of the rack and the carriage are required to affect travel along a given linear distance. For purposes of this disclosure the media M has been defined as a photosensentative film, plate or the like which is thin and relatively flexible. However the term media can further be used to define any material which is capable of conforming to the generaly semi-cylindric shape of the supply cassette and moved in the manner which is disclosed in the foregoing specification.

Accordingly, the invention have been disclosed by way of illustration rather than limitation.

We claim:

1. A cassette having a leading end and a trailing end for storing media comprising:

a body member having a body portion sheet defining a partially cylindrical support surface and a flat base fixed to said body portion sheet and being configured to be received within guide means;

a cover member received by the body member for sealing the cassette against light;

said body member and said cover member of said cassette each having a generally partially cylindrical configuration defined by spaced lateral edges;

said lateral edges of said cover member being outwardly turned and said lateral edges of said body member being inwardly turned with said laterally outwardly and inwardly turned lateral edges of said cover member and of said body member being complementarily sized and shaped to slidingly cooperate with one another to create a labyrinth therebetween;

said cover member including a crescent shaped end plate and said body member including a first end cap associated with the leading end of the cassette and a second end cap associated with the trailing end of said supply cassette; and locking means disposed between said cover member and said body member to lock the cassette against inadvertent opening.

2. A collecting tray which is capable of being inserted into the confines of a handling unit through an opening formed therein to retrieve media which has previously been scanned by a plotter, said tray comprising:

a first member having a generally rectangular form defined by long sides which extend in the direction of tray insertion into the unit and short sides extending generally orthogonally thereto, the shortsides thereof defining leading and trailing edges of the tray;

a rectangular block member connected to said first member at said trailing edge of said tray;

said block member having a height that is about twice the height of said first member, said block member extending below said first member such that the tray is capable of being inserted into said opening and supported in said unit while said rectangular block member is in sealing confrontation with said opening; and a cover dimensioned such that it is slidably engageable with and positionable over said first member while said collecting tray is maintained in the unit.

3. A media handling system comprising:

a unit defined by a frame having a base and a means disposed at the base of said frame for allowing said unit to be moved between one location and another to position one end of said unit adjacent a photoplotter;

a supply station means and a collecting station means mounted to and located on said frame;

a housing mounted to said frame and enclosing said unit, said housing having first and second openings disposed at opposed ends thereof, said first opening communicating with said supply station means so that a supply of media can be inserted into said unit through said first opening, said second opening being one through which media can be moved from said supply station means outwardly of said unit and onto a support surface of a plotter, said housing further having a third opening communicating with said collecting station means so that a collecting tray can be inserted through said third opening to receive scanned media from said plotter;

a rack having a given length defined by a first end and a second end separated from each other by the length of said rack and disposed above said supply station means and said receiving station means and being slidably mounted to said frame for movement between a first position whereat said rack first end is located generally above said supply station means and said second end is maintained within said frame and a second position whereat said rack second end is located outwardly of said frame so that a portion of said rack is cantilevered from said frame;

a carriage disposed on said rack for movement along said rack between said first and said second ends;

a first drive means capable of being energized and de-energized and associated with said rack for controllably moving said rack relative to said frame, said first drive means having a drive motor secured to said frame and a return pulley drivingly connected to one another through the intermediary of a first endless belt;

a second drive means capable of being energized and de-energized and associated with said carriage for controllably moving said carriage relative to said frame and said rack, said second drive means including a second drive motor and a second return pulley drivingly connected with one another through the intermediary of a second endless belt, said second drive motor and said second return pulley being disposed on said rack at opposite ends thereof;

said first belt associated with said first positioning means being connected to said rack and said second belt associated with said second positioning means being connected to said carriage;

drum means carried by said carriage and controllably moveable relative to said carriage between a vertical up and a vertical down position, said drum means having vacuum means associated with it for communicating a vacuum between it and a media sheet;

stop means associated with said rack and said carriage for defining end of travel limits for said rack and said carriage relative to said frame; and control means for controlling movements of said carriage and said rack by the controlled energization and de-energization of said first and second drive means to selectively locate the drum means at said supply station means, at an intermediate station located outwardly of said unit and above a plotting surface of a photoplotter, and at said collecting station means.

4. A media handling unit for moving media between discrete locations, said unit comprising: a frame, a supply means supported by said frame for providing a source of media conformed to a generally partially cylindric shape while being maintained in said supply means, a first positioning means located above said supply means and slidably movably mounted to said frame for movement between a first position generally above said supply means and a second position located outwardly of said frame, a second positioning means carried by said first positioning means for movement relative to both said frame and to said first positioning means, a third positioning means carried by said second positioning means and being vertically moveable relative thereto for lifting media from said supply means in a conformed partially cylindric shape and for maintaining said media in said conformed partially cylindric shape as said media is moved to discrete locations remote of said supply means under combined movements of said first and said second positioning means, and control means connected to each of said first, second and third positioning means for controlling the movements of the same to effect handling of media between said discrete locations.

5. A handling unit as defined in claim 4 further characterized in that said unit has a first end and an opposite second end, the first end of said unit being disposed adjacent said supply means and said second opposite end of said unit of being a delivery end of said unit, and wherein said first positioning means includes an elongate member having a first end and an opposite second end and having limits of travel defined generally by the locations of said supply means and of said delivery end of the unit.

6. A handling unit as defined in claim 5 further characterized in that said elongate member is slidably mounted on said frame and takes the form of a generally U-shaped rack, said rack having first and second ends defining a length thereof and being defined by two spaced apart rails each having a given height and a connecting transverse member extending between said two rails at said first end of said rack.

7. A handling unit as defined in claim 6 further characterized in that each of said rails of said rack includes first and second pairs of tracks spaced apart from one another by the height of said rail and wherein one track of each pair of tracks of each rail is slidably received within said frame and the other one of each pair of tracks is engaged by said second positioning means.

8. A handling unit as defined in claim 7 further characterized in that said second positioning means includes a drum carriage which includes means for engaging with and traveling along said other track of each pair of tracks.

9. A handling unit as defined in claim 8 further characterized in that said second positioning means includes a second drive means disposed on and secured to said rack and drivingly connected to said drum carriage for moving said drum carriage linearly along said rack between said first and said second ends thereof; and wherein said first positioning means includes a first drive means mounted to said frame and drivingly connected to said rack for positioning said rack between said limits of travel.

10. A handling unit as defined in claim 9 further characterized in that said frame includes a subframe rotatably supporting said rack generally adjacent said delivery end of said unit such that the rack is capable of being moved outwardly of said sub-frame and cantilevered therefrom.

11. A handling unit as defined in claim 10 further characterized in that said first and second track pairs associated with each of said rails of said rack being comprised respectively of a pair of upper and lower track edges and said frame including at least two pairs of vertically spaced and aligned rollers adapted to receive one upper and one lower track edge of each of said first and second track pairs and wherein said drum carriage includes at least two pairs of vertically spaced and aligned rollers correspondingly sized and shaped to receive the other upper and the other lower edge of the other track pair.

12. A handling unit as defined in claim 11 further characterized in that said one track of each first and second track pair being disposed laterally outwardly of the other track of each first and second track pair such that the drum carriage straddles between the rails of said rack; said first drive means including an endless belt and a return pulley located at the end of the frame opposite the location of said first drive means and said rack being attached to said belt for movement therewith; and wherein the second drive means includes a return pulley located at the second end of said rack opposite said transversely extending member and includes an endless belt trained between a second drive motor and said return pulley and connected to the drum carriage.

13. A handling unit as defined in claim 12 further characterized in that said third positioning means includes a positioning drum and said third positioning means vertically movably mounts said positioning drum to said drum carriage, and wherein said positioning drum includes a generally hollow partially cylindrical member communicating with a vacuum source and having an externally curved surface having a multiplicity of openings for communicating vacuum from within the hollow confines of the drum outwardly of its exterior surfaces.

14. A handling unit as defined in claim 13 further characterized in that said third positioning means includes at least one vertical actuator connected between the drum carriage and the positioning drum for causing the drum to be moved between vertical up and vertical down positions; and wherein at least one tension spring member is connected between said positioning drum and said drum carriage to assist the positioning drum movement back to its vertical up position when the at least one vertical actuator is deactivated.

15. A handling unit as defined in claim 14 further characterized in that said subframe includes oppositely disposed surfaces and said rack has a range of movement between a first end of said frame and a second end of said frame along a given line of travel defined by stop means associated with each of said first and second ends; said stop means including two abutments respectively engageable with said oppositely disposed surfaces of said subframe to limit in a first instance the rack to extending outwardly beyond said frame when one of said two abutments engages one of said oppositely facing surfaces of said subframe and in a second instance to limit said rack to a retracted position within the frame when the other one of said two abutments engages the other one of said oppositely facing surfaces of said subframe.

16. A media handling unit as defined in claim 15 further characterized by said second stop means also providing a limit of travel for said drum carriage as it moves in the direction of travel away from said supply means, a third stop means provided on said frame for causing the drum carriage to stop at a point intermediate the length of said rack, said third stop means being an activatable stop which is caused to be maintained in an inactive retracted state allowing the drum carriage to pass said activatable stop as the drum carriage travels away from the supply source and towards said discharge end of said unit and having an activated extended state corresponding to when the drum carriage is moved towards said supply means from said discharge end of said unit, said third stop means being located generally above the collecting station of said frame, and wherein said rack includes a fourth stop means disposed on said rack at its end opposite of said second stop means for engaging with said drum carriage as it moves along the line of travel toward the supply means.

17. A handling unit as defined in claim 16 further characterized by sensing means associated with said first, second, third and fourth stop means for sensing the end of travel of said drum carriage and of said rack as each of said drum carriage and said rack approaches its end of travel limit, and said control means being responsive to said sensing means to stop powered movement of said rack and of said drum carriage prior to said rack and said drum carriage impacting on the respectively associated ones of said first, second, third and fourth stop means.

18. A handling unit as defined in claim 4 further characterized in that attached to said frame is a housing which encloses the frame against light, said housing including a first opening sized and shaped to receive a supply cassette and communicating with said supply means, a second opening located at a delivery end of said unit and located opposite to and aligned with said first opening, and a third opening sized and shaped to receive a collecting tray and formed in said housing generally transversely to the alignment of the first and second openings, and wherein the first and third openings include seal means disposed about the perimeters thereof for maintaining light-tight integrity of the unit when a corresponding supply cassette and collecting tray are respectively inserted therein.

19. A handling unit as defined in claim 18 further characterized in that the second opening is defined by a bridging tunnel extending outwardly of said housing, said bridging tunnel at its distal end being provided with a perimeter of yieldable material capable of conforming to a surface onto which it is abutted, and wherein said frame includes a latching mechanism located at the delivery end thereof for connecting with a photoplotter to prevent relative movement therebetween.

20. A handling unit as defined in claim 19 further characterized in that associated with each of the first and third openings is a first and a second guide means, respectively, wherein a supply cassette is inserted into said first opening and is caused to travel along said first guide means associated with said first opening to position said supply cassette directly beneath said drum carriage, and wherein said third opening is associated with the second guide means disposed in line with said third opening for receiving a collecting tray which is inserted into said third opening.

21. A media handling unit as defined in claim 20 further characterized in that said supply means includes a cassette having a partially cylindrical support surface and a flat base, said flat base being configured to be received within said first guide means of said first opening and wherein said supply cassette is of two piece construction as defined by a body portion and a removal cover member.

22. A handling unit as defined in claim 21 further characterized in that said body member and said cover of said cassette each have a generally partially cylindrical configuration defined by spaced lateral edges, and wherein the lateral edges of said cover member are outwardly turned and wherein the lateral edges of said body member are inwardly turned with the laterally outwardly and inwardly turned lateral edges of the cover and the body members being complimentarily sized and shaped to slidingly cooperate with one another to create a labyrinth therebetween, and a locking device associated with said frame and said body member having means for locking the body member to the frame when the cassette is set in place within said unit and for locking the body member to the cover member when the cassette is out of the unit.

23. A handling unit as defined in claim 22 further characterized in that said cassette is defined along its length by a leading end and a trailing end and said cover member includes a crescent shaped end plate and said body member includes a first end cap associated with the leading end of the cassette and a second end cap associated with the trailing end of said supply cassette; and wherein said second end cap includes two inwardly directed slits which receive complimentarily sized and shaped portions of said cover member.

24. A handling unit as defined in claim 23 further characterized in that said second end cap has an outwardly directed surface and includes a locking device which causes the cover member end plate to be clamped against the outwardly directed surface of said second end cap.

25. A handling unit as defined in claim 24 further characterized by said supply cassette being defined along its length by a central axis including a plurality of flexible finger members disposed along its upper support surface, said members having a raised intermediate portion located generally coincidentally with the central axis of the cassette and having curved end portions extending outwardly from the raised intermediate portion generally coincidentally with the curved support surface of said body member;

said flexible finger members being responsive to downward pressure applied by the mounting drum as it is moved from its vertical up to its vertical down position so as to cause media to be moved into engagement with the mounting drum in response to the flexure generated by the finger members.

26. A handling unit as defined in claim 25 further characterized by said locking device having a cam member and a latch member integrally formed with the each other and being angularly offset by approximately 45 degrees; and wherein the cam member is capable of being rotated into engagement with the outer surface of the end plate of the cover member while leaving the latch member out of engagement with a connecting portion on the frame and said cam member being capable of rotating out of engagement with the end plate of the cover member while simultaneously causing locking engagement of the latch member with said frame.

27. A handling unit as defined in claim 18 further characterized in that said third opening has a given height and said frame supports a support plate and said second guide means extends generally orthogonally to the direction of travel of said media through said unit, said support plate providing a support surface which is located on said frame approximately one half the height (H) of the third opening, said support plate is adapted to receive a collecting tray having a generally rectangular form defined by long sides which extend in the direction of tray insertion into the unit and short sides extending generally orthogonally thereto, the short sides thereof defining leading and trailing edges of the tray with said trailing edge being defined by an elongate rectangular block, and wherein said the block has a height that is about twice the height of the remainder of said tray with said block extending below the remainder of said tray so that the tray is capable of being inserted into said third opening and supported on said support plate surface while said rectangular block is in sealing confrontation with the said third opening.

28. A handling unit as defined in claim 27 further characterized by a cover which is slidably engageable with and positionable over said collecting tray while said collecting tray is maintained in the unit; and wherein said housing includes a locking device engageable with said generally rectangular block of the collecting tray.

29. A media handling unit for moving media between discrete locations including the location of a supply of media and the location of a partially cylindric support surface, said media handling unit being further characterized by: a frame supported by means allowing the unit to be moved to and from a given position adjacent to and in engagement with a photoplotter of the type having a a partially cylindric support surface; a housing covering said frame so as to enclose the interior thereof against the passage of light, a first opening formed in said housing communicating with the location of a supply of media, said first opening having means for sealing it against light passage when a supply of media is contained in said unit, a second opening formed in said housing at a location which is close to said photoplotter when said unit is in said given position, said second opening including means for sealing it against light passage when the unit is in said given position, positioning means supported by said frame for causing a media sheet to be moved from a location internally of said housing and brought to a location externally thereof and positioned above said support surface of said photoplotter, lifting means carried by said positioning means for lifting a media sheet from said supply of media internally housed within said housing and for depositing a media sheet onto and subsequently lifting a media sheet from said support surface of said photoplotter, and control means for controlling the positioning means and the lifting means to effect movement of the media between discrete locations.

30. A handling unit as defined in claim 29 further characterized in that the second opening is defined by a bridging tunnel extending outwardly of said housing, said bridging tunnel at its distal end being provided with a perimeter of yieldable material capable of conforming to a surface onto which it is abutted, and wherein said unit includes a latching mechanism located at the discharge end thereof for connecting with the photoplotter to prevent relative movement therebetween.

31. A media handling unit as defined in claim 30 further characterized in that said supply of media includes a supply cassette having a partially cylindrical support surface and a flat base, said fiat base being configured to be received within said first opening and wherein said supply cassette is of two piece construction as defined by a body member and a removal cover member.

32. A handling unit as defined in claim 31 further characterized in that said body member and said cover member of said supply cassette each have a generally partially cylindrical configuration and have spaced lateral edges complimentarily sized and shaped to slidingly cooperate with one another to create a labyrinth therebetween, and a locking device associated with said unit and said body member having means for locking the body member to the unit when the supply cassette is set in place within said unit and for locking the body member to the cover member when the supply cassette is out of the unit.

33. A handling unit as defined in claim 32 further characterized by said supply cassette being defined along its length by a central axis including a plurality of flexible finger members disposed along its upper support surface, said members having a raised intermediate portion located generally coincidentally with the central axis of the cassette and having curved end portions extending outwardly from the raised intermediate portion generally coincidentally with the curved support surface of said body member;

said flexible finger members being responsive to downward pressure applied by the vertical means as the means is moved from its vertical up to its vertical down position so as to cause media to be moved into engagement with the vertical means in response to the flexure generated by the finger members.

34. A handling unit as defined in claim 29 further characterized in that said unit includes a third opening having a given height and a light seal disposed thereabout, a support plate disposed within said unit and extending generally orthogonally to the direction of travel of said media through said unit, said support plate providing a support surface which is located in said unit at approximately one half the height of the third opening, said support plate being adapted to receive a collecting tray having a generally rectangular form defined by long sides which extend in the direction of tray insertion into the unit and short sides extending generally orthogonally thereto, the short sides thereof defining leading and trailing edges of the tray with said trailing edge being defined by a elongate rectangular block, and wherein said rectangular block has a height that is about twice the height of the remainder of said tray, said rectangular block extending below said tray so that the tray is capable of being inserted into said third opening and supported on said support plate surface while said rectangular block is in sealing confrontation with the said third opening.

* * * * *